United States Patent [19]

Lockett

[11] 4,088,227

[45] May 9, 1978

[54] MULTIPLEXED SORTING APPARATUS WITH TEST CIRCUITRY

[75] Inventor: James F. Lockett, Houston, Tex.

[73] Assignee: Geosource Inc., Houston, Tex.

[21] Appl. No.: 704,652

[22] Filed: Jul. 12, 1976

[51] Int. Cl.[2] ..... B07C 5/342

[52] U.S. Cl. ..... 209/111.6; 209/74 M; 364/526

[58] Field of Search ..... 209/74 R, 74 M, 111.6, 209/111.7 R, 111.7 T; 356/178, 179; 250/226; 235/153 A; 340/214, 225, 408, 409, 410, 411, 413

[56] References Cited

U.S. PATENT DOCUMENTS

| | | | |
|---|---|---|---|
| 3,517,171 | 6/1970 | Avizienis | 235/153 A X |
| 3,665,399 | 5/1972 | Zehr et al. | 340/413 X |
| 3,867,039 | 2/1975 | Nelson | 209/111.6 X |
| 3,901,388 | 8/1975 | Kelly | 209/111.7 R |
| 3,977,526 | 8/1976 | Gordon et al. | 209/111.7 R |
| 3,980,181 | 9/1976 | Hoover et al. | 209/111.6 |

*Primary Examiner*—Robert B. Reeves
*Assistant Examiner*—Joseph J. Rolla
*Attorney, Agent, or Firm*—Arnold, White & Durkee

[57] ABSTRACT

A sorting apparatus wherein a plurality of first and second electrical color signals from a predetermined number of viewer elements are sampled by a time multiplexer, classified on the basis of the ratio of the color signals sampled from each viewer, and demultiplexed to actuate an ejector associated with each viewer if a comparison of the ratio classification signal with predetermined references indicates an unacceptably colored product or foreign object is characterized by circuitry for testing the digital logic elements associated with the sorting apparatus, and for sampling and displaying signal outputs from predetermined test points within the sorter circuitry at predetermined multiplex times.

6 Claims, 19 Drawing Figures

MULTIPLEXED SORTING APPARATUS WITH TEST CIRCUITRY

BACKGROUND OF THE INVENTION

Field of the Invention

This invention relates to apparatus for sorting articles disposed in a random fashion across an article stream according to a predetermined physical characteristic, such as color, and, in particular, to a sorting apparatus having an associated test circuit.

Cross-References to Related Applications

Subject matter disclosed herein is disclosed and claimed in the copending application of J. D. P. Jones, E. H. Codding, and M. A. Smither, Ser. No. 704,651, filed July 12, 1976, and assigned to the assignee of the present invention, and the copending application of J. F. Lockett, Ser. No. 704,697, filed July 12, 1976, and assigned to the assignee of the present invention.

Description of the Prior Art

Sorting apparatus for separating articles in a random article stream utilize a variety of physical characteristics on which to base the sort. In one area of activity, the in-field sorting of comestible products according to their reflected color characteristics, design activity of sorting apparatus has increased significantly in order to find alternatives to manual sorting. Such activity is economically justified by the increasing cost of in-field, manual labor previously utilized to sort acceptable from unacceptable products at the harvest site.

The sorting of comestible products according to their degree of ripeness is generally done on the basis of color differences between the ripe and the "green" products. U.S. Pat. No. 3,206,022 (Roberts) refer to one such color sorting machine in which apples are inspected, or viewed, and sorted according to their color characteristics at two selected wavelengths. This and other such color sorters, such as that described in U.S. Pat. No. 3,750,883 (Irving), however, require that the articles to be sorted be presented one at a time to a viewing zone or chamber for a color determination. The capacity of such sorters is limited by the need for singulation of the product. Although capacity can be increased by parallel operation of a number of such sorting machines disposed in side-by-side relationship, the cost is commensurately increased. In addition, such bichromatic color sorting machines are especially sensitive devices not suited to use in rugged harvesting environments. Further, the last-cited patent, due to its inability to reject foreign objects present in the product flow, totally vitiates its applicability to an in-field environment.

Also, in the context of color sorting, various bichromatic optical devices have been developed which determine the color of articles passing through an inspection chamber or viewing zone. For example, U.S. Pat. No. 3,867,039 (Nelson), assigned to the assignee of the present invention, relates to an optical system for viewing a large area of a product stream and generating an electrical signal representative of the average color of the articles in the viewed area. This apparatus, however, is not a sorting machine and does not respond to remove unacceptably colored products from the product flow. This apparatus is intended for production process control applications, in which the average color of the product stream is used to control various process parameters.

The sorting apparatus disclosed and claimed in the copending application of M. Hoover and E. Codding, Ser. No. 588,219, filed June 19, 1975, now U.S. Pat. No. 3,980,181 and assinged to the assignee of the present invention, also relates to sorting based upon the reflected color properties of an article. This device operates to sort articles passing through the fields of view of a plurality of side-by-side viewing sections without any requirement of channelization. That is, a sorting of articles disposed randomly across a wide article stream is effected, based upon the wavelengths of visible light reflected from the articles. Further, any foreign objects caried randomly along in the article stream are classified and ultimately rejected.

Also known to the art are devices which base a sort upon physical characteristics of articles in an article stream other than their color.

One such device, intended for sorting a flow of articles randomly located across a wide path, is described in U.S. Pat. No. 3,872,306 (Palmer). In this patent, ionizing radiation is used to identify and separate dirt clods and stones from potatoes as the potatoes are harvested. This device operates on the absorbancy characteristics of articles within the article stream. Another device for sorting such a stream of articles is described in U.S. Pat. No. 3,179,247 (Hutter), in which the separation of rock salt from other matter is accomplished on the basis of differences in translucency. Neither of these devices are appropriate in the context of in-field product sorting based upon color criteria since neither includes any bichromatic color sensing elements. Further, the Palmer patent does not utilize a ratio signal to classify product. U.S. Pat. No. 3,901,388 (Kelly), is a further example of prior art sorting apparatus which does not utilize a ratio signal to classify articles to be sorted.

In most of the prior art sorting machines which provide a multichannel sorting capability, usually the circuitry for performing the viewing, classifying and ejecting is redundantly provided for each channel. Thus, each channel has associated with it all the necessary components to perform the recited functions. This redundancy unnecessarily increases the cost of these sorting machines.

It would therefore be advantageous to provide a sorting apparatus to sort articles randomly disposed in an article stream with a reduced number of circuit components. Further, it is advantageous to provide a sorting apparatus with a foreign object reject capability operable to eject foreign objects from the article stream. It is also advantageous to provide a sorting apparatus which includes an enabling mechanism to actuate the color and foreigh object reject system only in the event that an article (the foreign object) has, in fact, passed the appropriate field of view.

The elimination of foreign objects, such as dirt clods, rocks, or the like, is a problem for some in-field sorting apparatus. In some prior art sorting machines, it is common practice to use light energy reflected from the product conveyor as a background intensity reference. However, it is found that the product conveyor becomes dirty or dusty as the sort progresses, thus vitiating the ability of the sorting apparatus to distinguish foreigh objects, such as dirt clods, from products. It is, therefore, advantageous to provide a sorting apparatus which uses, as a reference background,, a signal representative of an area other than the product conveyor.

Various prior art sorting apparatus utilize either the product conveyor or another suitably disposed member, both having predetermined reflectivity characteristics, to provide a background against which articles are detected. The prior art background also provides a reference signal against which articles are compared. It is advantageous, therefore, to provide a sorting apparatus which uses a non-reflective background region (a blackhole), against which articles are detected. It is also advantageous to provide a sorting apparatus which does not utilize the reflective characteristic of a background (either a conveyor or a separate member) to classify articles, but instead uses reference signal values otherwise generated.

Other prior art sorting apparatus, especially those providing a bichromatic sort, use only the magnitude of a singal representative of light refelcted at one predetermined wavelength as the basis for a foreighn object rejector. This has a tendency to eliminate certain acceptably colored products. It is therefore advantageous to provide a sorting apparatus for in-field sorting environments which uses the ratio of bichromatic signals as the basis for foreigh object rejection.

SUMMARY OF THE INVENTION

A sorting apparatus, in which a plurality of first and second electrical color signals from a predetermined number of electrical signal generators associated with a corresponding number of viewer elements are sampled by a time multiplexer and a ratio classification signal related to the color ratio of the signals sampled is generated, has test circuitry associated therewith whereby signal levels at predetermined points within the sorting apparatus circuitry may be sampled at any predetermined multiplex time and suitably displayed. The test circuitry includes means for sampling and holding the output of predetermined circuit points and displaying that sampled signal. Enabling means are provided to enable the sample and hold circuitry only during predetermined multiplex times. The signal sampled during a predetermined multiplex time is held and displayed on a suitable meter display for the time required for the multiplexer to step from that time period to the next occurrence of the selected time period. A new sample is then taken and is similarly held and displayed.

BRIEF DESCRIPTION OF THE DRAWINGS

The invention will be more fully understood from the following detailed description of a preferred embodiment, taken in connection with the accompanying drawings, in which.

DESCRIPTION OF THE PREFERRED EMBODIMENT

Figure 2:
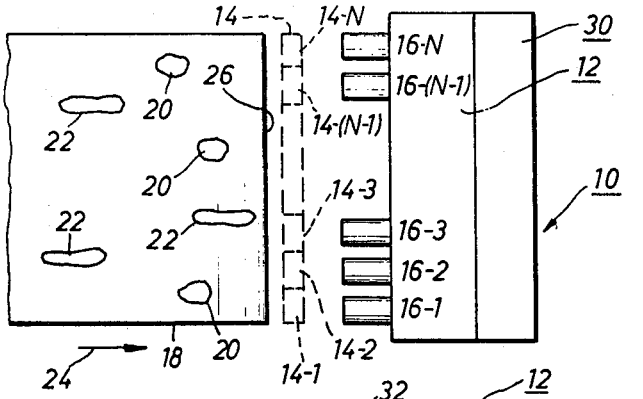
FIG. 2 is a plan view of a sorting apparatus shown in FIG. 1.

Throughout the following description, similar reference numerals refer to similar elements in all Figures of the drawings.

Figure 1:
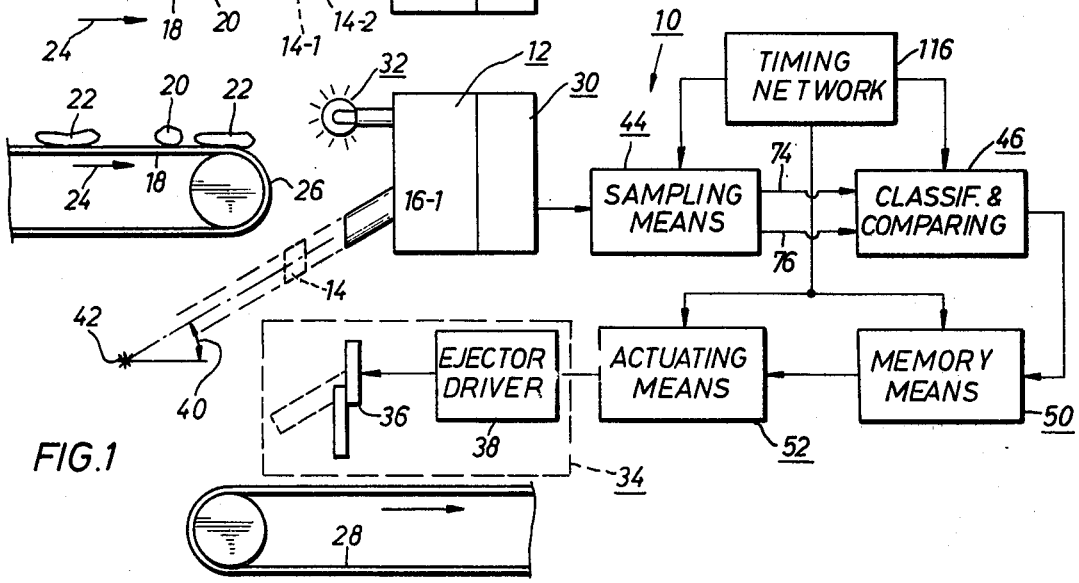
FIG. 1 is an elevational view of the sorting apparatus for sorting articles according to a predetermined physical characteristic, such as color, embodying the teachings of this invention.

Referring first to FIGS. 1 and 2, respectively shown are a side elevational view and a plan view of the mechanical elements of a sorting apparatus generally indicated by reference numeral 10 embodying the teachings of this invention. The sorting apparatus 10 is operable to sort articles randomly disposed across an article stream according to predetermined physical characteristics of the articles, such as the color of the article or its dissimilarity to foreign objects.

As shown in FIGS. 1 and 2, the sorting apparatus 10 is preferably operable in the environment of an in-field harvesting operation and includes viewing means 12 for viewing an illuminated viewed area, diagrammatically indicated at 14, through which an article stream is passed. The viewing means 12 may comprise a plurality of N viewer elements, or viewers, indicated by reference numerals 16-1, 16-2, 16-3, . . . 16-N. The 16-1 . . . 16-N viewers are disposed in a side-by-side arrangement so as to completely encompass within their field of view the illuminated area 14. Each of viewer elements 16-1 . . . 16-N is arranged so as to view one of a correspondig plurality of sectors 14-1 . . . 14-N into which the viewed area 14 is divided. The viewed area 14 (comprising the N viewed sectors) had a width commensurate with the tranverse width of an upper article conveyor 18. It has been found that for most applications for sorting comestible articles, such as tomatoes, a conveyor width of 22 inches is utilized. Therefore, 22 viewer elements 16, each assigned to view a one inch wide viewed sector of the viewed area 14 is a suitable number of viewer elements to provide an accurate sort. Of course, conveyors of other sizes and other viewer-sector width assignments are within the contemplation of this invention.

Articles to be sorted according to a predetermined physical characteristic, such as color and dissimilarity to foreign objects, are disposed across the article conveyor 18 in an entirely random fashion. Such articles, for example, harvested tomatoes, are indicated in the figures by reference numeral 20. Also carried along the upper article conveyor 18, in a similarly random disposition, are unwanted foreign objects, such as dirt clods or the like, indicated by reference numeral 22. Such foreign objects 22 may be inadvertently and inconveniently disposed upon the upper article conveyor 18 during the harvesting process.

The products 20 to be sorted according to a predetermined physical characteristic, such as color, and the unwanted foreign objects 22 are carried in a direction 24 along the upper article conveyor 18 to the discharge end 26 thereof. At the discharge end 26, the products 20 and the foreign objects 20 fall freely from the upper article conveyor 18 toward a second, lower article conveyor 28. During their free-fall, both the products 20 and the foreign objects 22 pass through the viewing area 14. Each product 20 or foreign object 22 passes through at least one sector 14-1 . . . 14-N of the viewed area 14 and is viewed by at least one of the viewer elements 16-1 . . . 16-N. The sorting apparatus 10 includes signal generating means 30 associated with each of the viewer elements to generate a first and a second electrical signal representative of light energy within first and second predetermined ranges of wavelengths reflected from articles passing through the sector of the viewed area corresponding to the particular viewer element. Also provided at any convenient location in the apparatus 10 is means 32 for illuminating the article flow. The means 32 provide a source of electromagnetic energy (light) radiated upon the article flow, which energy is reflected from articles within the article stream and gathered by the viewing means 12. Electrical signals generated by the signal generating means 30 are utilized to classify each article, as is discussed fully herein. If the physical characteristic used to classify articles as acceptable or unacceptable is the color reflected therefrom, then the illumination means 32 may include, for example, a plurality of fluorescent lights. It is understood, of course, that numerous other sources of illumination known in the art may be utilized.

The sorting apparatus 10 is operable to prevent those articles not exhibiting certain physical characteristics, such as failure to meet certain acceptable color criteria, from reaching the lower conveyor 28. Also, the apparatus 10 is operable to prevent the deposition upon the lower conveyor 28 of foreign objects 22 exemplified by dirt clods or the like. The elimination of unacceptable articles and unwanted foreign objects is effected by ejecting means 34 for ejecting articles classified by the sorting apparatus as unacceptable, (i.e., articles which fail to exhibit a predetermined physical characteristic) from the article stream. It is also within the teachings of this invention to "eliminate" desired articles (i.e., articles which exhibit a predetermined physical characteristic) from the article stream by actuation of the ejecting means 34. The ejecting means 34 includes a plurality of ejector elements 36, each driven by an associated ejector driver 38, each ejector element 36 being associated with one of the viewer elements 16. It is understood that although the ejectors drivers 38 and ejector elements 36 may be disposed in any convenient manner and location, the ejector elements 36 (corresponding to each viewer element 16-1 . . . 16-N) are located in a position to interdict the free-fall path from the upper to lower conveyors.

Figure 8A:
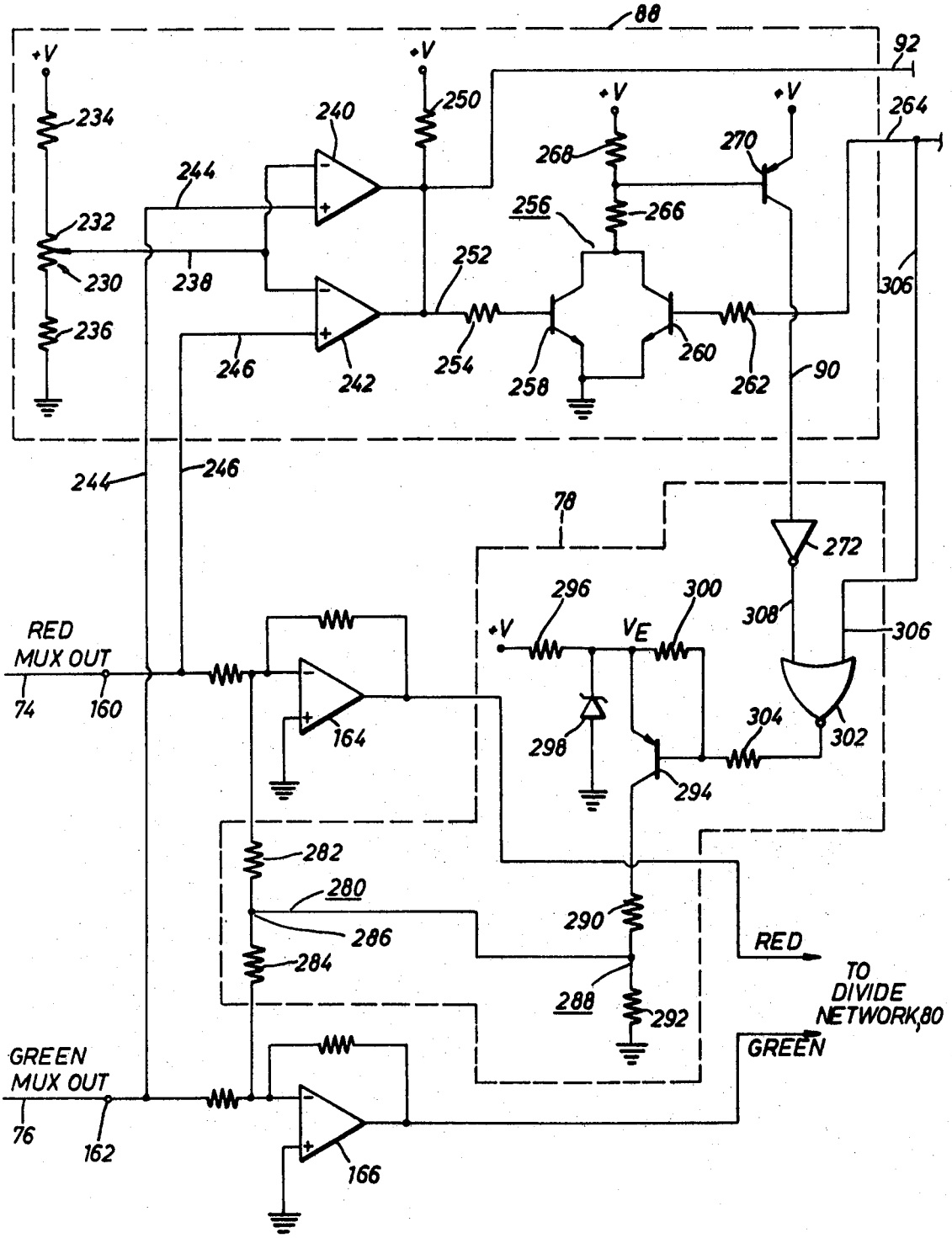
FIGS. 8A and 8B are schematic diagrams of a portion of the electronic circuitry utilized in a sorting apparatus embodying the teachings of this invention.

As seen in FIG. 1, each of the 16-1 . . . 16-N viewers is oriented to define a predetermined angle 40 with the horizontal. When no articles are within sectors 14-1 . . . 14-N of the viewed area 14 associated with a particular viewer 16-1 . . . 16-N, that viewer is trained upon a reference region 42 located beneath the upper article conveyor 18. This reference region 42 is known as the "black hole," and the signal generating means 30 associated with the viewers 16-1 . . . 16-N viewing this region generate little or no signal output. Prior art sorting apparatus typically rely upon the conveyor itself or another background member, both having predetermined reflectivities, to generate a reference signal when no product is viewed. However, as discussed earlier, this practice is subject to problems. The sorting apparatus embodying the teachings of this invention uses the "black hole" region 42 as a non-reflective background region against which light energy reflected from articles in the article stream is detected. The black hole region does not, and is not utilized to provide, a reference signal against which articles are classified. As is seen herein, the articles are compared and classified against reference signals set into comparator arrangements 176 and 198–200 (FIG. 8A).

Although the electronic circuitry embodied in the sorting apparatus 10 is discussed more fully herein, FIG. 1 illustrates sampling means 44 for sampling the first and second electrical signal outputs from the signal generating means 30 operably coupled to the viewing means 12. As discussed herein, the sampling means 44 may conveniently be a multiplexer which samples the information input thereto associated with each of the 16-1 . . . 16-N viewers and presents that information over first and second electrical transmission paths to means 46 for classifying and comparing the sampled electrical signals. The means 46 is connected within the transmission paths and generates a plurality of electrical classification signals. Each classification signal is functionally related to the ratio of the first and second electrical signals sampled from the signal generating means 30. The means 46 also includes means for comparing the classification signals generated with predetermined reference signals (as discussed more fully herein) and for generating reject signals if an article passing through one of the sectors 14-1 . . . 14-N is classified as unacceptable. Memory means 50, having a plurality of memory locations therein, is operatively coupled to the classification and comparing means 46 to store a reject signal in a memory location corresponding to the sector 14-1 . . . 14-N of the viewed area 14 through which an article classified as unacceptable (due to the exhibition by that article of a predetermined physical characteristic) is passed. A reject signal is stored in a particular memory location for a predetermined period of time corresponding to the time an article requires to pass from the viewed area 14 into proximity to the one of the ejector elements associated with the viewer 16A . . . 16N which views the particular sector. Actuating means 52 are operatively associated with the memory means 50 for actuating the particular one of the ejector drivers 38 associated with the corresponding ejector element 36.

Figure 3:
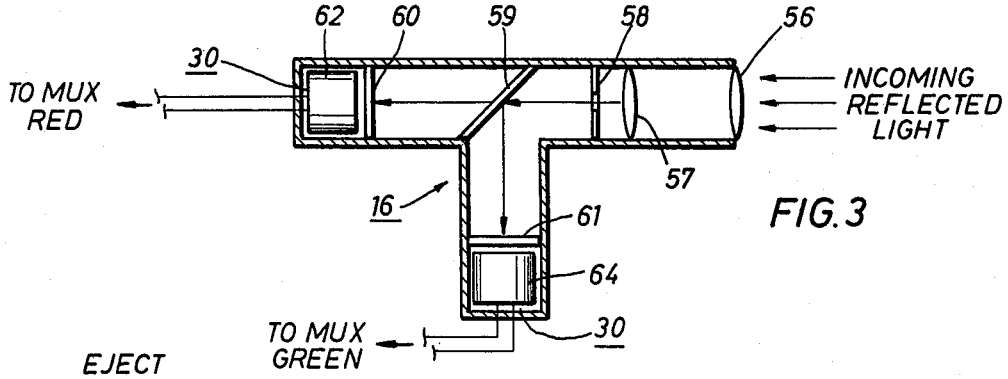
FIG. 3 is a sectonal view of an individual viewer element of an apparatus for sorting articles embodying the teachings of this invention.

Each of the viewer elements 16-1 . . . 16-N includes a lens arrangement, indicated in FIG. 3, comprising an object lens 56, a defocusing lens 57, an adjustable optical frame member 58, a beam splitter 59, and first and second filters 60 and 61, each located in respective portions of the split beam. The signal generating means 30 may include first and second light sensors 62 and 64, such as solar cells, which receive the light passed through the filters 60 and 61. As products 20 and foreign objects 22 are discharged from the upper article conveyor 18 and freely-fall to the lower article conveyor 28, each of the articles passes, as discussed, through at least one sector 14-1 . . . 14-N of the viewed area 14 and is therefore viewed by at least one of the viewers 16-1 . . . 16-N. The light reflected from the article passes into the appropriate viewer 16 through the object lens 56, defocusing lens 57, and the optical frame member 58. The light passing through the optical frame member 58 is directed to the beam splitter 59. The beam splitter 59 passes a portion of the light through the first filter 60 to the first light sensor 62 and reflects the remaining portion of light through the second filter 61 to the second light sensor 64.

If the physical characteristic on which the sort is based is color, the filters 60 and 61 are selected according to the colors which are used to define an article as an acceptable or unacceptable product. For example, when the apparatus of the present invention is utilized to sort tomatoes according to color, the filters 60 and 61 are selected to pass light in narrow bands about the appropriate red and green wavelengths, respectively. The light passing through each filter 60 and 61 impinges upon the corresponding light sensors 62 and 64. The filtered light received by each of the light sensors 62 and 64 is completely diffuse, having no image characteristics of the articles from which the gathered light is reflected. The filtered light rather represents the instantaneous light energy reflected from articles within predetermind color bandwidths as the articles pass through one of the side-by-side sectors 14-1 . . . 14-N of the viewed area 14.

Each of the light sensors 62 and 64 generates an electrical signal representative of the intensity of the filtered light impinging upon it. When apparatus according to the present invention is utilized to sort green tomatoes from red tomatoes, the magnitudes of the electrical signals present at the outputs of the light sensors 62 and 64 are indicative of the amounts of red and green color of the articles as they pass through the sector 14-1 . . .16-N of the viewed area 14 corresponding to one of the viewer elements 16-1 . . .16-N.

It may therefore be appreciated that there extends from the output of each of the signal generatng means 30 (the light sensors 62 and 64) associated with each of the viewer elements 16-1 . . . 16-N, two color signals, one electrical signal representative of the light reflected from the article within a predetermined range of wavelength about a first color wavelength and a second electrical signal representative of the light reflected from the article within a predetermined range of wavelengths about a second color wavelength. Of course, if a dirt clod or other foreign object 22 is viewed by one of the viewer elements 16, the magnitude of the light within each color wavelength range reflected from the foreign object 22 is also indicated by an appropriate electrical signal on the output lines from the signal generating means 30 associated with the viewer element. Finally, if neither a product 20 nor a foreign object 22 passes through a viewed sector 14-1 . . . 14-N of the viewed area 14, electrical signals (ideally, of zero magnitude) indicative of the "black hole" area 42 are output from the signal generating means 30 associated with the appropriate viewer element.

It is appreciated that for a bichromatic (two color) system, if there are N viewer elements, there are at least 2N output lines from the signal generating means 30 associated with those viewer elements connected to the sampling means 44 (FIG. 1). As will be seen herein, the sampling means 44 samples the 2N-parallel information streams input thereto from the signal generating means 30, and presents that sample signal on two output lines (one for each color) leading from the sampling means 44 to the classification and comparing means 46.

Figure 4:
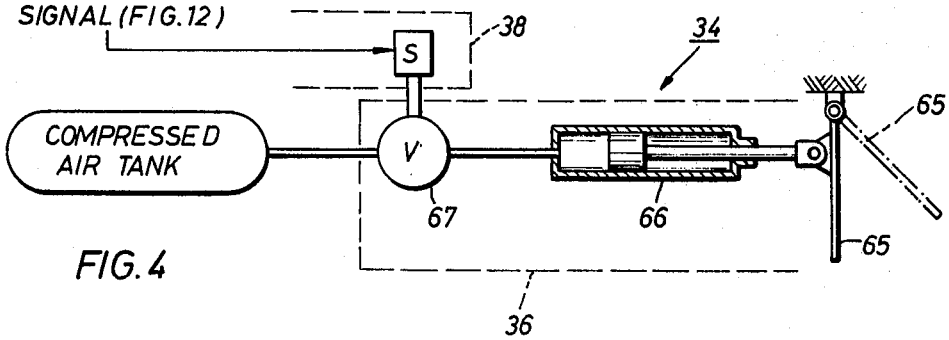
FIG. 4 is a pictorial representation of an ejector element associated with each viewer element embodying the teachings of this invention.

Before passing to a more detailed discussion of the circuitry of the sorting apparatus, reference is directed to FIG. 4 where a more detailed description of the ejecting means 34 is shown. The ejecting means 34 includes an ejector driver 38 (discussed in more detail herein) operatively associated with an ejector element 36. The ejector driver 38 is associated with the actuating means 52 (FIG. 1) in a manner to be discussed herein. Each of the ejector elements 36 (associated with each viewer element 16-1 . . . 16-N) includes a paddle 65, extensible (as shown in dashed lines) from a first position to an article intercept position. The paddle 65 is connected to a piston-cylinder arrangement 66. The piston-cylinder arrangement 66 is connected through an electrically operated valve 67 to a source of operating fluid such as compressed air. The valve 67 is operated by a solenoid S within the ejector drive 38 which responds to an eject signal in a manner to be described. It is understood that any suitable ejecting means 34, actuated in a manner as developed herein, is within the contemplation of this invention.

Figure 5:
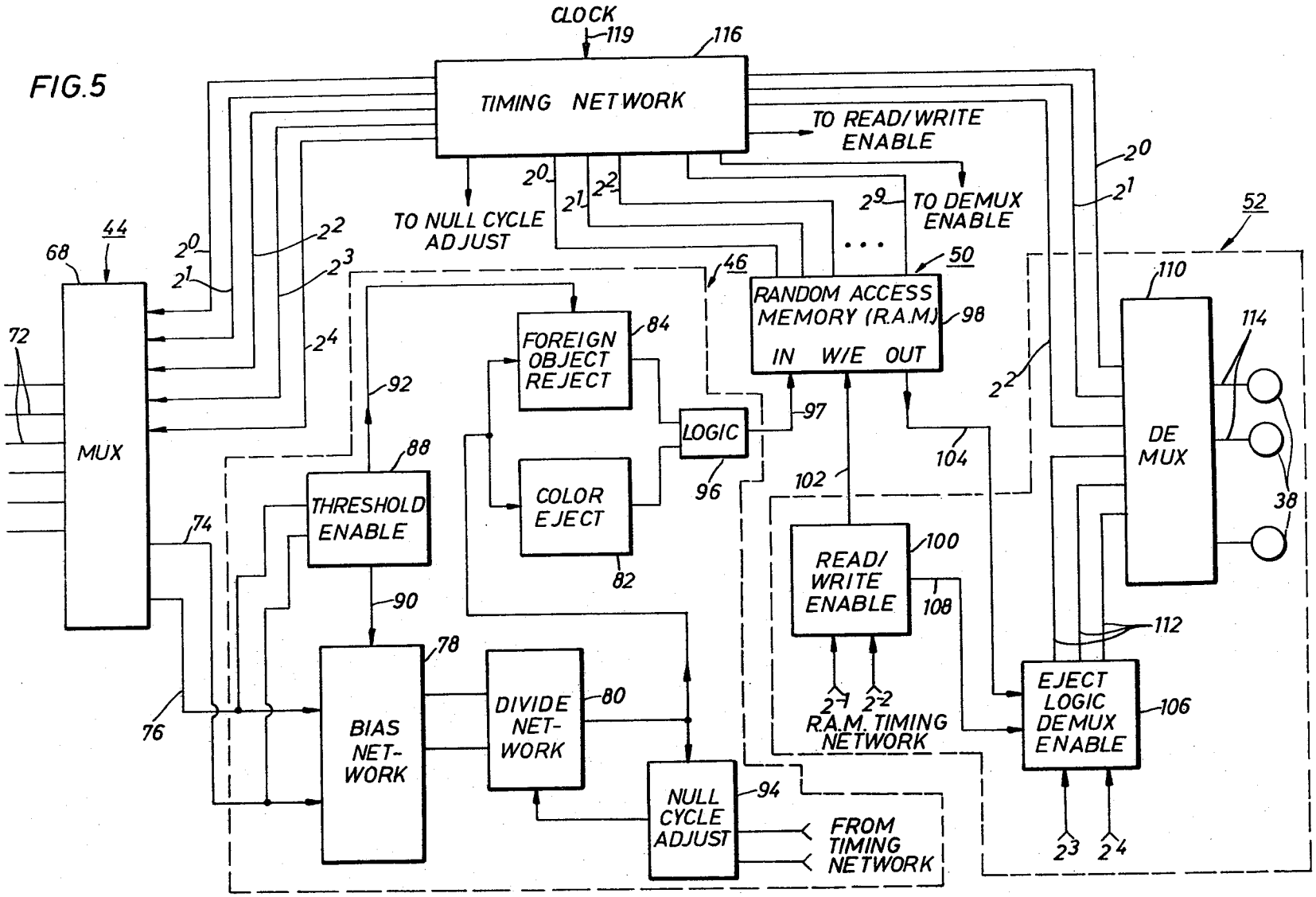
FIG. 5 is a block diagram of circuitry utilized by a sorting apparatus embodying the teachings of this invention.

Referring now to FIG. 5, a block diagram of circuitry utilized in a sorting apparatus 10 embodying the teachings of this invention is disclosed.

The sampling means 44 comprises multiplex unit, generally indicated by reference numeral 68, which is connected to an output line 72 emanating from each of the first and second light sensors 62 and 64 which comprise the signal generating means 30 associated with each viewer element 16. Appropriate preamplification of the signals is provided. The multiplexer unit 68 operates to sample, after preamplification, the parallel outputs from each of the N Red and each of the N Green light sensors (62 and 64, respectively), and present the sampled signal for transmission over first and second electrical transmission paths, such as output signal lines 74 and 76. The outputs of the sampling means 44 are connected to the classification and comparing means 46.

More specifically, the output signal lines 74 and 76 from the multiplex unit 68 are connected to a bias network 78. The bias network 78 is, in turn, coupled to a divide network 80 which generates classification signals functionally related to the ratio of the electrical signals on the lines 74 and 76. The analog output of the divide network 80 is coupled to a color comparator network 82 and to a foreign object comparator network 84. Connected in parallel to the output lines 74 and 76 from the multiplexer unit 68 is a threshold enable network 88. One output line 90 of the enable network 88 is connected operatively to the bias network 78. A second output line 92 from the enable network 88 is connected to the foreign network classifier network 84.

A null cycle adjust network 94 is connected in a feedback loop between the output of the divide network 80 and the input thereof. The null cycle adjust network 94 is enabled during the "null cycle" of multiplex operation to provide a nulling function to the divide network 80, as is described in more detail herein.

The output from the classification and comparing means 46 is connected to the memory means 50. More specifically, the outputs from the comparator networks 82 and 84 are connected through a logic network 96 by a line 97 to the Data Input terminal of a random access memory element 98. The memory element 98 contains a plurality of memory locations, corresponding to each sector 14-1 . . . 14-N of the viewed area 14, access to which is stepped in synchronism with the stepping action of the multiplex unit 68 as it is moved through the outputs 72 from each of the 16-1 through 16-N viewer elements. The memory means 50 is connected to the actuating means 52.

The random access memory 98 is connected to a read/write enabling network 100 through a line 102. The output of the memory 98 at the DATA OUT terminal is connected through a line 104 to a demultiplex enable logic network 106. Logic network 106 is also coupled to the enabling network 100 through a line 108. The output of logic network 106 is coupled to a demultiplex unit 110 through lines 112. The demultiplex unit 110 actuates the appropriate ejector driver 38 (FIG. 4) over lines 114. During the time that a multiplex channel is up, the networks 100 and 106 provide means which read a signal previously stored in a predetermined memory location and which transmit a signal to the demultiplex unit 110 to actuate the appropriate ejector driver 38 if the previously stored signal is a reject signal. The networks 100 and 106, as will be made clear herein, also provide means for writing a current article classification signal into the addressed memory location while the multiplex channel is up.

A timing network 116 provides master controlling pulses to synchronously direct the stepping function of the sampling means 44 (the multiplexer unit 68) and the actuating means 52 (the demultiplex unit 110) with the addressing of the memory means 50 (the locations within the memory element 98). These elements may be sequentially stepped if desired. The timing network 116 has input thereto a reference clock frequency from which a plurality of binary frequencies are generated. Also, the enabling functions of the network 100 are controlled by the timing network 116 so that the read and write activities discussed herein may be performed during the time that each individual channel of the multiplex unit 68, demultiplex unit 110, and the memory element 98 is addressed.

From the block diagram of the apparatus circuitry hereinabove presented, it is appreciated that the multiplex unit 68 and the demultiplex unit 110 are synchronously stepped to predetermined channels therein corresponding to each of the viewer elements 16 at the same time that locations in the memory element 98 corresponding to those viewer elements (and therefore corresponding to predetermined sectors of the viewed area) are addressed. The synchronous stepping of the multiplex unit 68, the memory element 98, and the demultiplex unit 110 is usually, but not necessarily, sequential. It is appreciated that as multiplex unit 68 is stepped, the signals present at the outputs of the signal generating means 30 associated with each of the viewers 16 viewers sampled and a classification signal functionally related to the ratio of the signals from the means 30 is generated. This classification signal is compared to various levels to determine if the color of the article is acceptable and if the article is dissimilar to a foreign object by the comparators 82 and 84, respectively. The comparator 84 is actuated only if the network 88 indicates that signals at the output of the multiplex unit 68 indicate an article is, in fact, within the sector of the viewed area viewed by the viewer element 16. During the time that the multiplex unit 68 has a particular channel up, the memory location synchronously addressed is first read, the information previously stored therein (if an eject signal) generating a signal from the enable network 106 to enable the demultiplex unit 110 to actuate the appropriate ejector driver 38 associated with the viewer element 16 being sampled. After this read-out has occurred, the result of the current classification and comparison operation is entered into the addressed memory location. This current classification and comparison information is stored until the predetermined period of time passes at which time that particular memory location is again described.

Having described in general the elements and operation of the sorting apparatus 10 embodying the teachings of the invention, attention is directed to the FIGS. 6 through 15 wherein implementing circuitry for each element above described is set forth in full so as to enable one skilled in the art to make and use the apparatus embodying these teachings and to set forth the best mode contemplated for carrying out this invention. It is, of course, understood that the implementing embodiments are illustrative only and that it is possible within the art to implement the functions described by various techniques other than those shown, all of which are included within the contemplation of this invention.

Figure 6:
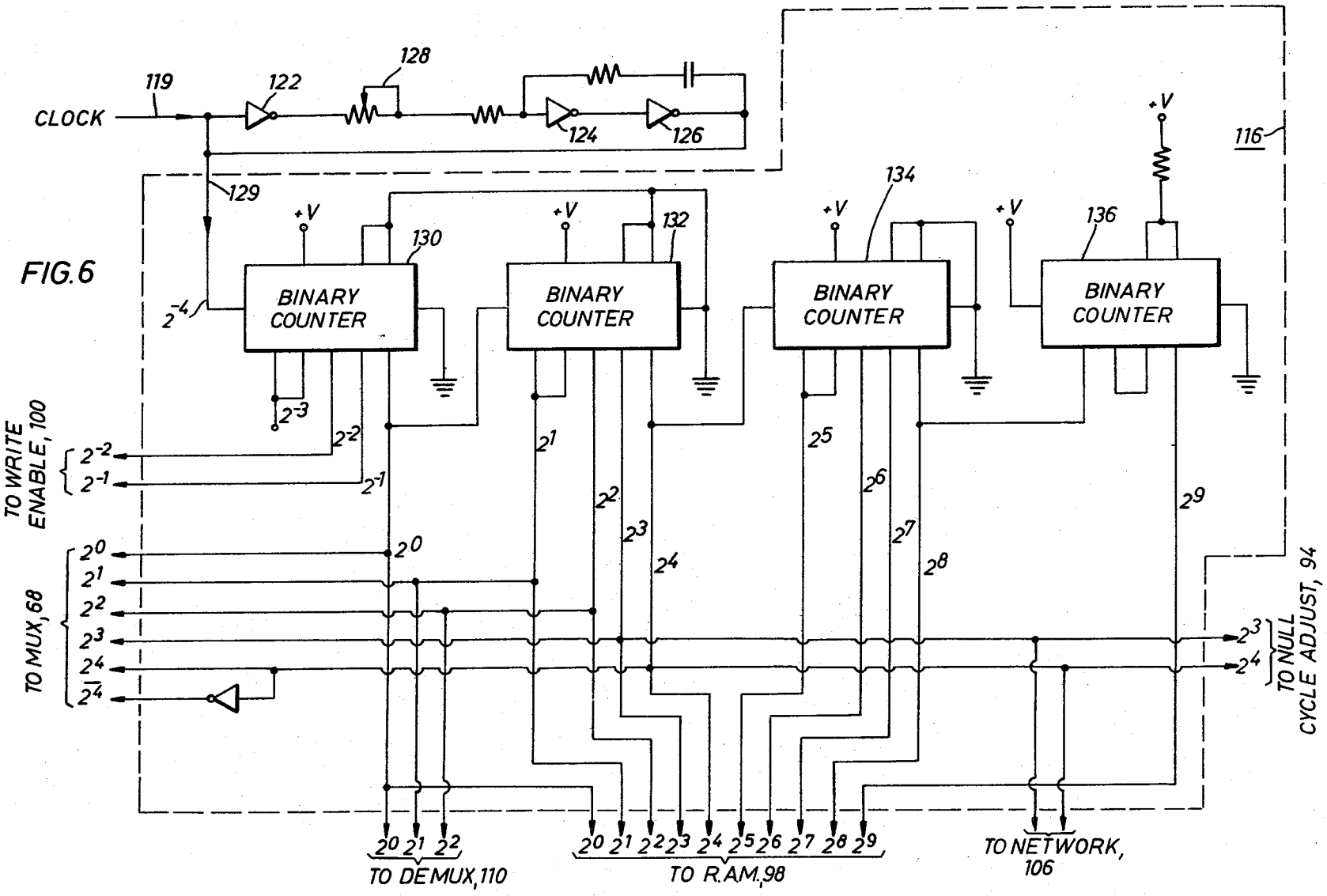
FIG. 6 is a schematic diagram of a timing network utilized in a sorting apparatus embodying the teachings of this invention.

Referring now to FIG. 6, a schematic representation of a timing network 116 utilized in a sorting apparatus 10 embodying the teachings of this invention is shown. Input to the timing circuit 116, on a line 119, is a clock signal from which a digital frequency of $2^{-4}$ is generated. The digital frequency $2^{-4}$ is generated from the clock signal by inverters 122, 124 and 126 connected by an oscillator. The frequency of oscillation is variably controllable by the potentiometer 128. The digital frequency $2^{-4}$ is output on a line 129 to the first counter 130 of a plurality of cascaded binary counters 130, 132, 134, and 136. Any standard quad flip-flop element such as those designated 74L93 sold by Texas Instruments ma be used as elements 130, 132 and 134, while the element 136 may be a 74L74 manufactured by Texas Instruments.

The cascaded counter arrangement 130–136 produces, on a plurality of output lines, a series of digital frequencies arranging from $2^{-4}$ to $2^{9}$ which are utilized as timing pulses throughout the remainder of the sorter apparatus circuitry.

The manner by which the timing circuit 116 produces a plurality of frequency signals representing various binary powers of 2 is well known to those skilled in the art. As seen in FIG. 6, frequencies representing $2^0$ through $2^9$ are operatively connected from the timing network 116 to the random access memory element 98. The multiplex unit 68 is coupled with output lines from the timing network 116 corresponding to binary frequencies $2^0$ through $2^4$. Also connected to the multiplex unit 68 is a frequency $\overline{2^4}$ produced by an inversion of the frequency signal on the line $2^4$. The demultiplex unit 110 is connected to the output lines $2^0$ through $2^2$ of the timing network 116, while the demultiplex enable logic circuitry 106 is connected to lines $2^3$ and $2^4$. Connected from the timing network 116 to the read/write enable circuitry 100 are the frequencies on line $2^{-2}$ and $2^{-1}$.

Frequencies representing $2^3$ and $2^4$ are also connected to the null cycle adjust circuit 94.

It is appreciated that the timing network 116 provides timing pulses for stepping both the multiplex unit 68 and demultiplex unit 110 together in synchronization with the addressing of the memory locations with the random access memory element 98. In this manner, data input from each of the signal generating means 30 corresponding to each of the plurality of viewer elements 16-1 . . . 16-N is synchronously multiplexed, stored, recalled, and demultiplexed to the appropriate corresponding ejecting means. These above operations may also, but not necessarily, be performed in sequency through the N channels.

The basic frequency, generated from input frequency $2^{-4}$, and utilized throughout the circuit is $2^0$. The periodicity of the basic frequency $2^0$ defines the actual channel time that the multiplex unit 68 and the demultiplex unit 110 dwell upon the signals from each of the N viewers. Frequencies greater than the basic frequency to $2^0$ ($2^{-1}$ and $2^{-2}$) are utilized to trigger operations during the channel time when each of the N channels is up. Frequencies less than the basic frequency $2^0$ ($2^1$ through $2^9$, $\overline{2^4}$) provide binary counting pulses to trigger operations in the sorter circuitry.

Figure 7:
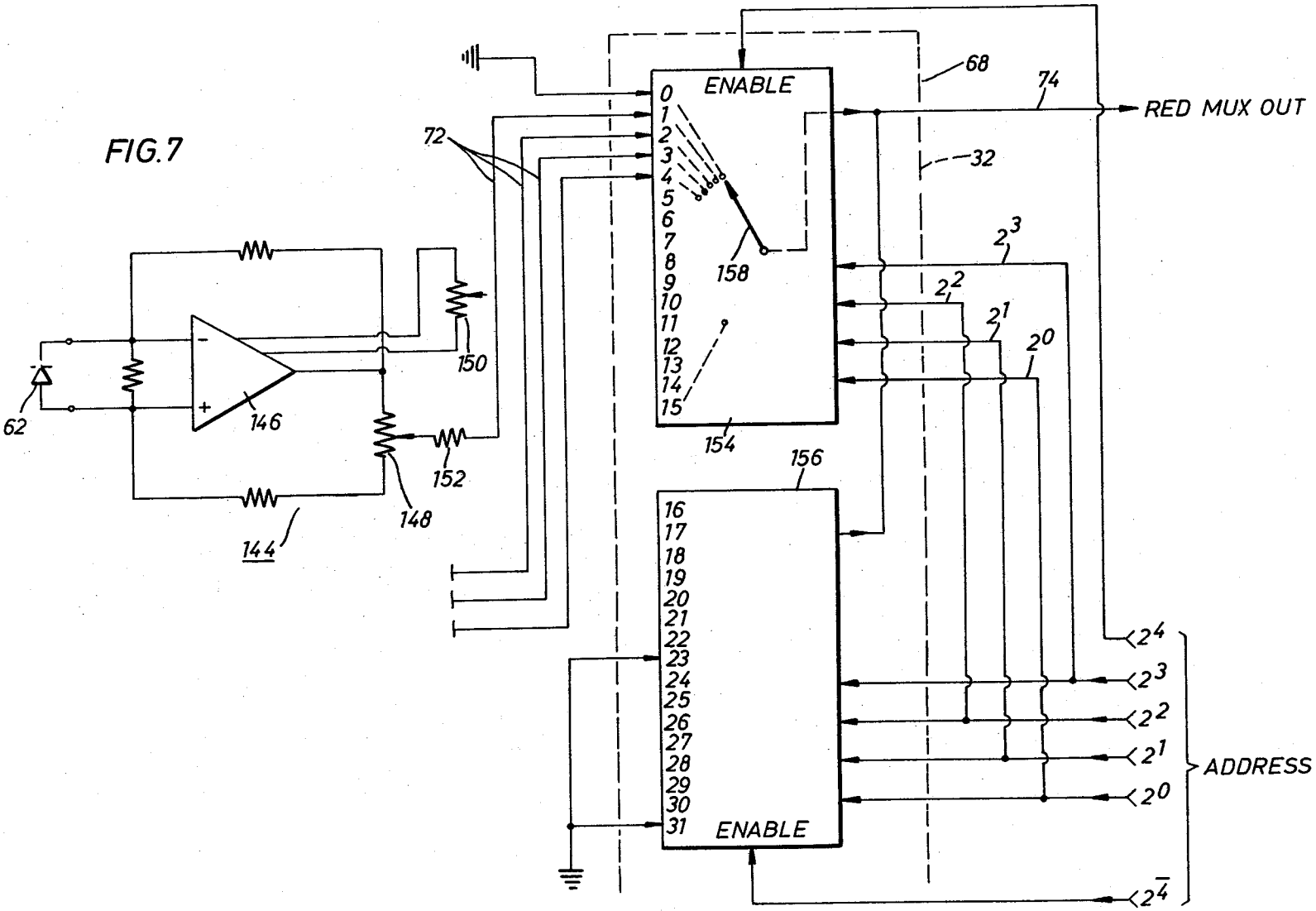
FIG. 7 is a schematic diagram of a multiplexer utilized in a sorting apparatus embodying the teachings of this invention.

With reference now to FIG. 7, the multiplex unit 68 and its interface with the N viewer elements 16 within the sorting apparatus 10 is illustrated in greater detail. As stated, the multiplex unit 68 is included with the sampling means 44. As stated earlier, it is found that use of 22 viewer elements 16, each covering a 1-inch sector of the viewed area 14 (FIG. 1), is effective to provide an optimum product sort. Therefore, hereinafter, it is assumed that data from each of the 22 viewer elements is presented to the multiplex unit 68. It is also made clear in connection with FIG. 3 that if there is a two-color sort, each of the 22 viewers has associated therewith signal generating means 30 which puts forth two electrical signals indicative of the magnitude of the light energy reflected from an object passing within the sectors 14-1 . . . 14-N of the viewed area 14 associated with the particular viewer element 16 at first and second predetermined ranges of color wavelengths, e.g., red and green. Thus, it is appreciated that a total of 44 information bearing lines — 22 from the red light sensors 62 and 22 from the green light sensors 64 — are input to the multiplex unit 68.

In order to handle this incoming data, the multiplex unit 68 is comprised of two multiplexing sections; one for the red signal inputs from the red light sensors 62 and one for the green signal inputs from the green light sensors 64. It is appreciated that during the discussion which follows the multiplexing section for the input signals from red light sensors 62 is described in detail, and that a corresponding multiplexing section is provided for the input signals from the green light sensors 64.

In FIG. 7, there is shown at 144 means for preamplifying the outputs from each of the red light sensors 62. Each green light sensor 64 is associated with a similar preamplificaton arrangement. The red light sensor 62 responds to incident light energy to initiate a current flow therethrough. The current outputs of the light sensor 62 is connected to the inputs of an amplifier 146 which converts the current input to a voltage output. A typical amplifier 146 is that manufactured by Analog Devices under model number S10. A gain adjust potentiometer 148 is connected to the output of the amplifier 146 to control the voltage output within predetermined limits, usually 0–10 volts, according to the magnitude of the input current. Also provided to the amplifier 146 is a null adjust potentiometer 150 operable to produce a zero output from each amplifier 146.

As seen in FIG. 7, the multiplexing section connected to each of the 22 red light sensors 62 comprises a first and a second circuit element 154 and 156. Suitable elements are those manufactured by Harris Semiconductor under model number HI506A. Each element 154 and 156 has a 16 channel capacity, therefore it is necessary to provide a cascaded chip arrangement in order to accommodate the 22 information channels input thereto. Each element 154 and 156 has, in effect, a switch contactor 158 switchable between the 16 input positions (0–15) provided in the element. Thus, while the element steps through each channel connected thereto, the information on that particular input line 72 is output from the multiplex unit 68 on the output line 74 identified as RED MUX OUT.

The 16 pins on the first element 154 are connected such that pin 0 is grounded, pin 1 is connected to the first viewer 16-1 (multiplex channel 1), pin 2 to the second viewer 16-2 (multiplex channel 2), etc. Since the fifteenth viewer 16-15 (multiplex channel 15) is cnnected to the last available pin on the element 154, the sixteenth viewer 16—16 (multiplex channel 16) is connected to the first input position on the element 156. The pins on the element 156 are connected until ach of input lines 72 from the 22 red light sensors 62 are affixed to the appropriate input pin. The remaining unused pins (positions 23-31) are grounded and comprise the "null cycle" which is described more fully herein. Thus, a serial data output over RED MUX OUT line 74 comprises, sequentially, a ground signal, 22 data information signals, and nine ground signals (the last eight of which comprise the null cycle). The elements are stepped, as will be seen, in accordance with the frequency $2^0$ and the actual dwell time on each channel is controlled by the period of $2^0$. This dwell period may be altered by altering the period of the waveform $2^0$ through adjustment of the variable resistor 128 (FIG. 6). It is again emphasized that an analogous switching operation occurs for the GREEN signals from the light sensors 64, and that a GREEN MUX OUT line 76 is also provided from the multiplex unit 68.

Figure 8B:
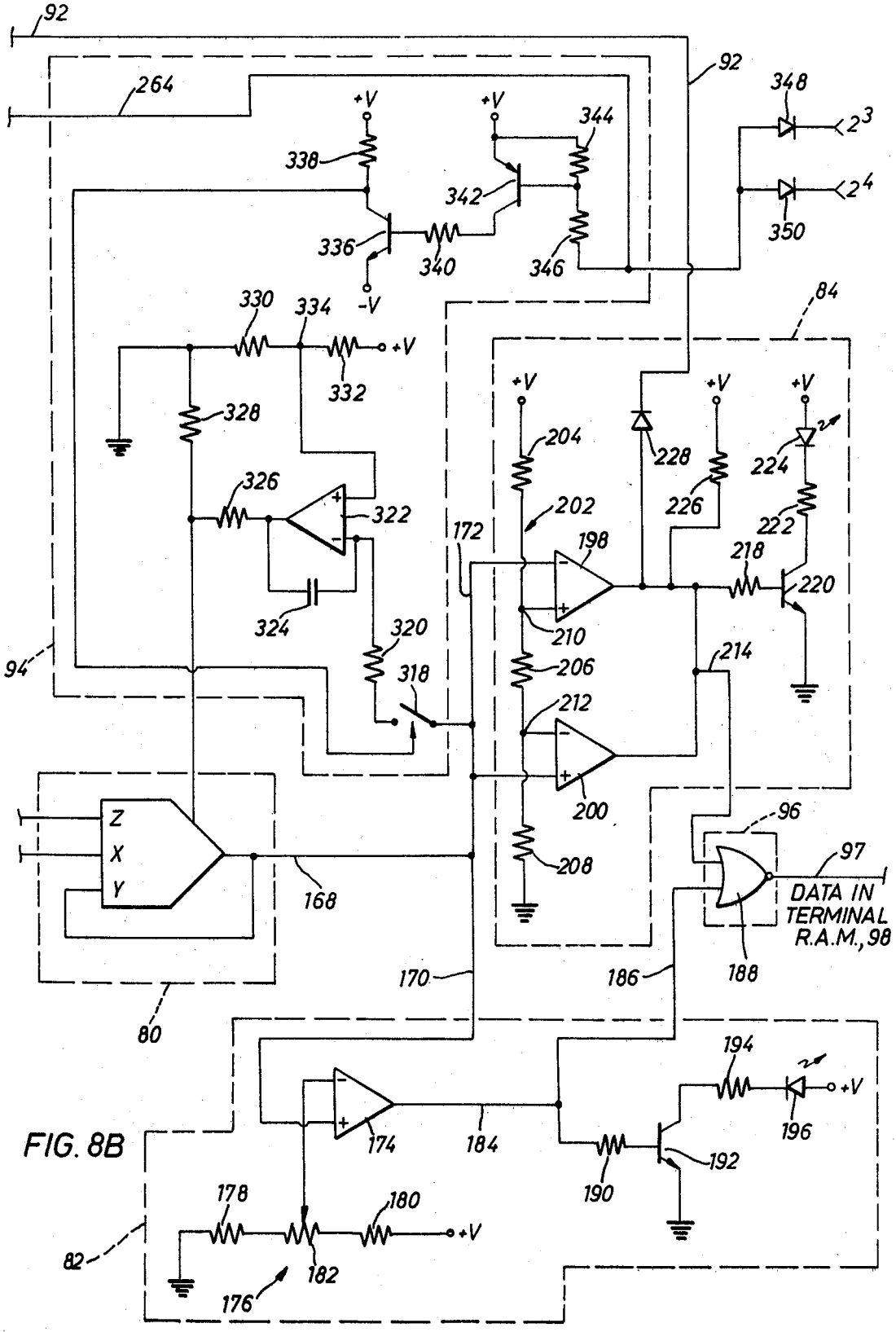

Referring now to FIGS. 8A and 8B, a schematic diagram of the classification and comparing means 45, which includes the bias network 78, the divide network 80, the color and foreign matter comparator networks 82 and 84, respectively, the switch enable network 88, the null cycle adjust network 94, and the logic network 96 is shown. The output lines 74 and 76 from the green and red multiplexing sections of the multiplex unit 68, RED MUX OUT and GREEN MUX OUT, are connected to terminals 160 and 162, respectively. Sampled informaion in an analog voltage format from each of the 22 input channels, preceded by a ground signal and followed by nine grounded channels (indicative of the null cycle) are therefore serially presented from the red multiplexing and from he green multiplexing sections through the terminals 160 and 162, respectively.

Amplifiers 164 and 166 are connected to the terminals 160 and 162, respectively. The gains of the amplifiers 164 and 166 are set at different levels from one another for compatability with the divide network 80. The inverted and appropriately scaled signals at the outputs of the amplifiers 164 and 166 are connected to the divide network 80 (FIG. 8B).

The divide network 80 operated to provide a real number analog voltage outut representing the quotient of the inputs thereto. The divide circuit 80 is arranged so that an equality of values appearing at the input terminals thereof results in a constant value appearing at the output thereof. The value of the constant is determined and maintained throughout a scan of the 22 viewer channels in accordance with the operation of the null cycle adjust network 94. A suitable divide network 80 is that provided by Analog Devices, Inc., under model number AD532. The output line 168 of the divide network 80 is connected to the clor commparator network 82 by a line 170 and to the foreign object comparator 84 by a line 172.

The line 170 is connected to the non-inverting terminal of a comparator 174, such as that manufactured by National Semiconductor under model number LM311. A reference voltage is connected to the inverting input of the commparator 174, the reference being adjustably provided from a Color Trip Reference Network 176. The network 176 includes resistors 178 and 180 and a variable resistor 182. If the analog output voltage on the line 170 is more positive than the reference voltage presented to the inverting terminal of the comparator 174, a digital logic high pulse appears on an output line 184 from the comparator 174. The output line 184 is connected, through a line 186, to the logic network 96, which comprises a suitable logic element, such as a NOR gate 188. The output of NOR gate 188 is coupled to the Data In terminal of the memory element 98 by the line 97. Visual indication of an unacceptably colored product is provided by the connection of the line 184 to a network including a resistor 190, an NPN transistor 192, a resistor 194, and a light emitting diode (L.E.D.) 196.

The output line 168 of the divide network 80 is also coupled, through the line 172, to the foreign object comparator network 84 which includes comparators 198 and 200. Suitable comparators are those manufactured by National Semiconductor under model number LM311. The inverting input of the comparator 198 and the non-inverting input of the comparator 200 are both tied to the line 172. The inverting input of the comparator 200 and the non-inverting input of the comparator 198 are each connected to a voltage divider network 202. The network 202 includes resistors 204, 206 and 208 connected in series between a positive source and ground, with the comparator 198 tied to a point 210 and the comparator 200 tied to a second point 212 having a lower potential than the point 210. These potentials define a voltage "window" indicative of the presence of a foreign object in the particular sector of the viewed area corresponding to one of the viewers 16. The outputs of the comparators 198 and 200 are tied together through a line 214 which in turn is itself connected to the NOR gate 188.

A visual indication of the presence of a foreign object is provided by a network including a resistor 218, an NPN transistor 220, a resistor 222, and a light emitting diode (L.E.D.) 224. The tied output of the comparators 198 and 200 is coupled to a positive voltage source through a resistor 226 and to the anode of a diode 228. The diode 228 is connected to the switch enable network 88 through the line 92.

If the output of the divide network 80 falls within a predetermined range of values or "window" defined by the reference voltages at the points 210 and 212, a digital high output pulse appears on the line 214 leading to the NOR gate 188. In other words, if the signal on the output line 172 is less positive than the reference to the comparator 198 and more positive than the reference on he comparator 200, a logic high pulse appears on the line 214 into the NOR gate 188. It is understood that the constant value output voltage from the divide network 80 when the inputs thereto are of equal value (the constant being defined by the null cycle adjust network 94) lies within the window defined by the comparators 198 and 200.

As the output of the divide network 80 deviates away in a decreasing manner from the constant value output, the object viewed is closer to the red clor (acceptably colored product). As the output of the divide network 80 deviates away from the constant value output in an increasing manner, the article viewed is unacceptably colored product (green tomato). It is appreciated that when a dirt clod or other foreign object is viewed (or when no product is viewed) the divide network 80 is presented with equal inputs. Such equality of inputs then generates, by definition and action of the null cycle adjust network 94, the constant value voltage output from the divide network 80.

Figure 10:
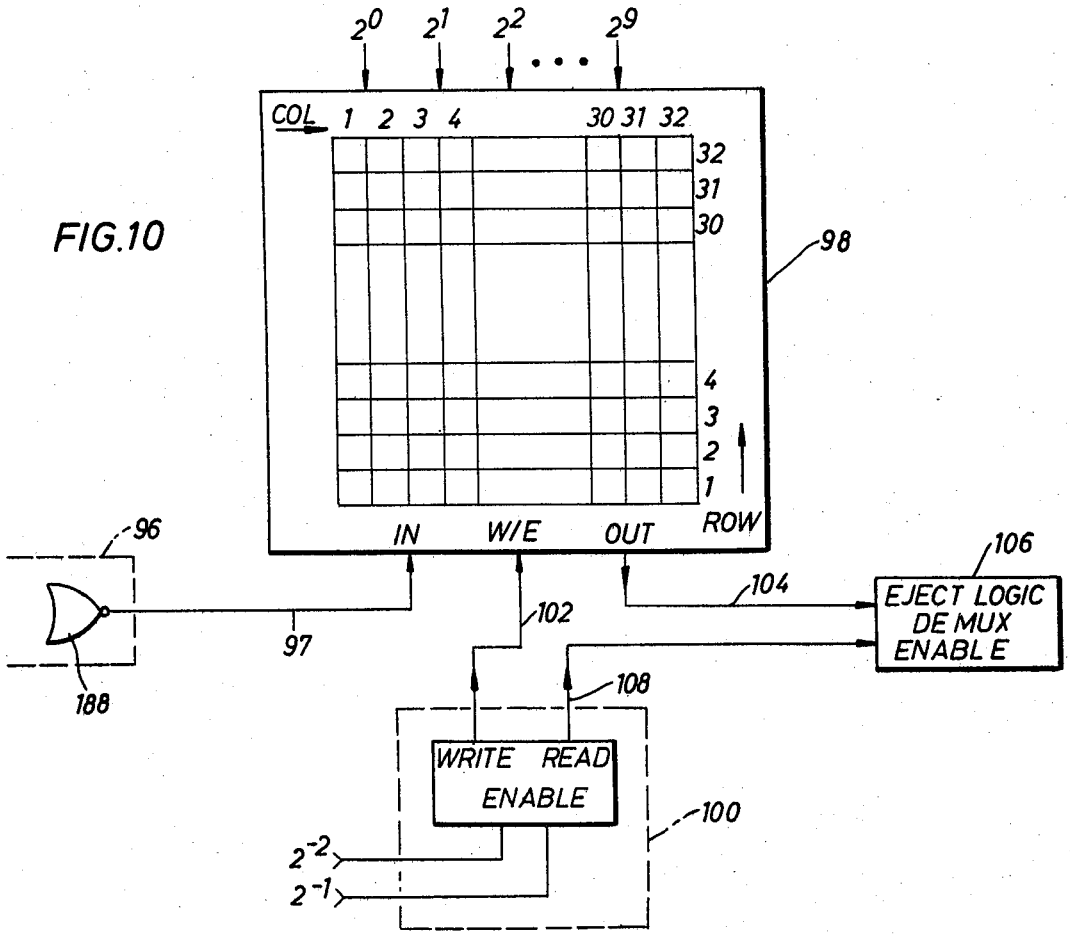
FIG. 10 is a schematic diagram of the memory and enabling circuitry associated therewith utilized in a sorting apparatus embodying the teachings of this invention.

It is also understood that the logic NOR gate 188 normally has a logic high value at its output. This logic high is presented by the line 97 to the Data In terminal of the memory element 98 (FIG. 10). If, however, there occurs a digital high pulse at the output of comparators 82 or 84 (FIG. 5), that is, on either of the lines 186 or 214 (FIG 8A), indicative of a reject condition due to (FIG. presence of an unacceptably colored product or a foreign object, a logic low appears at the output of the NOR gate 188 and at the Data In terminal of the memory element 98. Thus, during the period of time when the particular memory location assigned to the viewer element where the multiplex channel that is up is addressed, the logic low, indicative of a trip or eject condition, is read into the appropriate memory location in a manner to be described herein.

Connected in parallel across the green and red multiplex inputs on the terminals 160 and 162 is the switch enable network 88. The switch enable network 88 includes a threshold voltage network 230, including a variable resistor 232 and resistors 234 and 236 (FIG. 8A). The voltage set by the threshold voltage network 230 is presented through a line 238 to the inverting inputs of comparators 240 and 242. Suitable for these circuit elements are comparators manufactured by National Semiconductor under model number LM311. As seen, the non-inverting input of the comparator 240 is connectd, through a line 244, with a multiplexed output from the GREEN MUX OUT appearing at the terminal 162 of the amplifier 166. Similarly, he non-inverting input of the comparator 242 is connected through a line 246 with the voltage outputs of the RED MUX OUT appearing at terminal 160 of the amplifier 164. The oututs of comparators 240 and 242 are connected by the line 92 to the cathode of the diode 228 (FIG. 8B).

The tied outputs of the comparators 240 and 242 are also connected to a positive source through a resistor 250 and, through a line 252 and a resistor 254, to a transistor logic network 256. The transistor logic network 256 includes a first NPN transistor 258 connected at its base to the outputs of the comparators 240 and 242. The collector of the transistor 258 is connected to the collector of a second transistor 260, also of the NPN type. The base of the transistor 260 is connected, through a resistor 262, to a line 264 leading from the null adjust cycle network 94 (FIG. 8B) to be described in more detail herein.

The tied collectors of the transistors 258 and 260 are connected to a positive source through resistors 266 and 268. The base of a PNP transistor 270 is connected between the resistors 266 and 268. The emitter of the transistor 270 is connected to a positive voltage source while the collector is connected through a line 90 to a bias network 78.

The bias network 78 operates to present predetermined voltage levels to the divide network 80 in the event that no article is in the view of any one of the viewer elements, and during the null cycle. As mentioned, presentation of equal voltages to the divide network 80 results in an output thereof falling within the predetermined voltage "window" of the comparators 198 and 200.

The bias network 78 includes a first voltage divider 280 including resistors 282 and 284 connected between the inverting inputs of the amplifiers 164 and 166. Connected to a node 286 is a second voltage divider 288, including resisitors 290 and 292. The resisitor 290 is tied to the collector of a PNP transistor 294. The emitter of the transistor 294 is tied to a positive voltage source through a resistor 296. A zener diode 298 also is provided. The base of the transistor 294 is connected to the positive voltage source by a resistor 300 and to the output of a NOR gate 302 through a resistor 304. The NOR gate 302 is connected at one input to the null cycle adjust line 264 by a line 306 and at its second input by a line 308 connected to the output of an inverter 272, the input of which is connected to the switch enable network 88 by the line 90.

In operation, during those periods when no product is in view or during the null cycle, the bias network 78 is operative to insure presentation of the appropriate analog voltages to the divide network 80. At the output of the NOR gate 302, the signal is a logic 0 (or digital low) when no article is detected or during the null cycle. With the output of the gate 302 low, the transistor 294 is rendered conductive. The zener diode 298 has established a predetermined voltage $V_E$ volts at the emitter of the transistor 294. A lower voltage is present at the collector thereof. At the node 286, a relatively high bias voltage is applied to he amplifiers 164 and 166.

Through the operation of the bias network 78, a voltage is introduced to the amplifiers 164 and 166 that is appropriately valued and scaled for the divide network 80 and that is much greater than any offset from the preamplifiers. Thus, offsets of the preamplifiers are rendered minimal at the input to the divide network 80 by the bias voltages introduced to the inputs to the amplifiers 164 and 166 through the resisitors 282 and 284.

Figure 9:
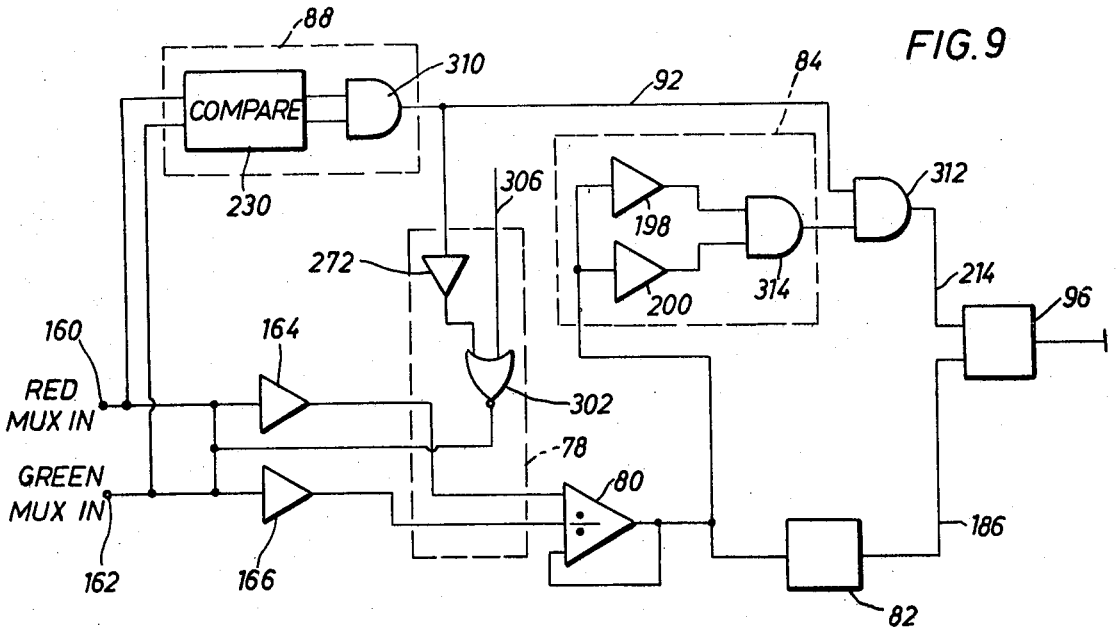
FIG. 9 is a schematic diagram of a portion of the circuitry shown in FIGS. 8A and 8B.

Although the detailed operation of the entire apparatus will be discussed herein, it is advantageous to briefly discuss the function of the switch enable circuitry 88 through the medium of logic circuitry shown in FIG. 9. As the multiplexed inputs are amplified and inverted by the amplifiers 164 and 166, they are simultaneously presented to the switch enable network 88. If the magnitude of the signals exceeds a predetermined value set by the threshold network 230 (FIG. 8A), positive pulses appear at the input and the AND gate 310 and the gate 310 is enabled. The output of the AND gate 310 is connected to the inverter 272 and to an AND gate 312. Note that due to the presence of the inverter 272, the NOR gate 302 is not enabled and the transistor 294 (FIG. 8A) is not conductive. Therefore, the outputs of the amplifiers 164 and 166 are introduced to the divide network 80. If the AND gate 310 is not enabled, a logic high from the inverter 272 enables the NOR gate 302 to actuate the bias network 78 to present the appropriate voltages to the divide network 80.

The output of the divide network 80 is presented to he clor comparator network 82 and the foreign object comparator network 84. If an unacceptably colored product is presented to the comparator 82, an appropriate output is presented to the logic network 96. The output of the divide network 80 is simultaneously presented to the foreign object comparator 84 and, only if the criteria of the comparators 198 and 200 is met, will an AND gate 314 be enabled. However, he coincidence of both an output pulse from the AND gate 314 and an enable pulse on line 92 from the AND gate 310 is required in order to enable the AND gate 312 to present an input pulse on the line 214 to the logic circuit 96.

Referring again to FIG. 8B, the null adjust network 94 is connected from the output line 172 of the divide network 80 through a normally open switch 318 and through a resistor 320 into the inverting input of an amplifier 322. The amplifier 322 may be that manufactured by Motorola under model number MC741. The output of the amplifier 322 is fed back through a capacitor 324 to the inverting input thereof and also through resistors 326 and 328 to ground. The grounded side of the resistor 328 is connected in series to resistors 330 and 332 which are in turn connected to a positive voltage source. The non-inverting input of the amplifier 322 is connected to a point 334 located between the resistors 330 and 332. The switch 318 is connected to the collector of a NPN transistor 336, the emitter of which is connected to a negative voltage source. The collector of the transistor 336 is connected through a resistor 338 to a positive voltage source and the base is connected through a resistor 340 to the collector of a PNP transistor 342. The emitter of the transistor 342 is connected both to a positive voltage source and to a biasing arrangement comprising resistors 344 and 346. The resistor 346 is connected through diodes 348 and 350 to the timing network 116 (FIG. 6) and specifically to the outputs $2^3$ and $2^4$ thereof. The anodes of each of the diodes 348 and 350 are connected to the NOR gate 302 through the lines 264 and 306.

Upon initiation and connecion of channel 23 (a guard band) and channesl 24 through 31 (the null cycle) of the multiplex unit 68 and demultiplex unit 100, it is appreciated that both the lines $2^3$ and $2^4$ are high, causing the line 264 to be high. Therefore, transistors 336 and 342 do not conduct to close the switch 318. This closes a negative feedback loop including the amplifier 322, the capacitor 324, and resistors 320, 326 and 328 so that the divider output tends to match the voltage at the point 334. Thus, at all times when the divide network 80 is called upon to divide numerators and denominators of equal value, a constant voltage output appears on the output line 168 thereof.

It is appreciated that coincident with the closing of the transistor 318 a high pulse appears at the NOR gate 302 and causes a logic low value to appear at the output thereof. Thus, transistor 294 becomes conductive to actuate the bias network 78 and present the appropriate voltages to the divide network 80. The capacitor 324 is provided so as to maintain the value of voltage on the resistor 326 to insure that the proper bias voltage is introduced to the divide network 80 so that a proper output voltage of predtermined constant value appears at the output 168 at the times during the next scan through the 22 viewer elements when equal values are presented to the divide network 80. Thus, the null cycle adjust network 94 in effect comprises a sample and hold circuit which maintains the output of the divide network 80 at the constant value so as to permit the divide network 80 to provide this constant value on the lines 170 and 172 to the window comparators 198 and 200 when the divide network 80 divides equal numerators and denominators. Of course, as seen above, such a case occurs when either a foreign object or no article is in view of the appropriate viewing screen. In the former case, biasing of a high level on the cathode of the diode 228 from the switch enable network 88 permits a positive pulse to appear on the line 214, while in the second case, forward biasing of the diode 228 prevents the appearance of a positive pulse on the line 214.

Referring now to FIG. 10, a schematic diagram of the memory element 98 and the associated enabling circuitry 100 is shown. Any suitable random access memory element 98, such as that manufactured by Siliconex under the number IM6508, may be utilized. The memory element 98 has 1024 memory locations disposed in a matrix array of 32 columns and 32 rows. The memory locations are addressed sequentially, proceeding as shown in FIG. 10 from column 1 rows 1 through 32, column 2 rows 1 through 32, and likewise until the entire array of 1024 locations is traversed. The addressing of the memory locations is synchronized with the stepping of the multiplex unit 68 and demultiplex unit. It is understood that the delay time for the entire apparatus is determined by the amount of time that it would take the memory to be addressed to any given column and row location, stepped through the entire 1024 memory locations, and returned to the original memory location. This delay time, therefore, corresponds to the time required for an article to pass from within a viewed sector to the area of the ejectors. It may also be appreciated that this time is functionally related to the dwell time of each multiplex channel, in that the time delay of the apparatus is seen to be the product of 1024 multiplied by the half period of the basic frequency $2^0$.

As each location in the random access memory element 98 is addressed sequentially through the introduction of control pulses from the timing network 116, information contained on the output line 97 of the logic network 96, corresponding to the classification of the article viewed by each of the 22 viewers 16, is inserted into memory and there stored until the appropriate time when the information is read out of memory to actuate the demultiplex unit 110 and thereby the ejecting means associated with the respective viewer. Thus, it is appreciated that each time an individual channel is up to sample a particular viewer 16, it is necessary to effect both a reading-out of the previous classification signal in the particular addressed memory location, and to effect a writing-in of the current classification signal.

The read and write enable control for the memory element 98 is provided through the read/write enable network 100. This network comprises, for example, an integrated circuit element such as 74LS139, manufactured by Texas Instruments.

It is be noted in FIG. 10 that the read/write enable network 100 is connected to the timing network 116 and particularly to the lines $2^{-1}$ and $2^{-2}$. Thus, there are defined four separate time segments during any one time that the reference frequency $2^0$ is holding one of the multiplex channels on.

Figure 11:
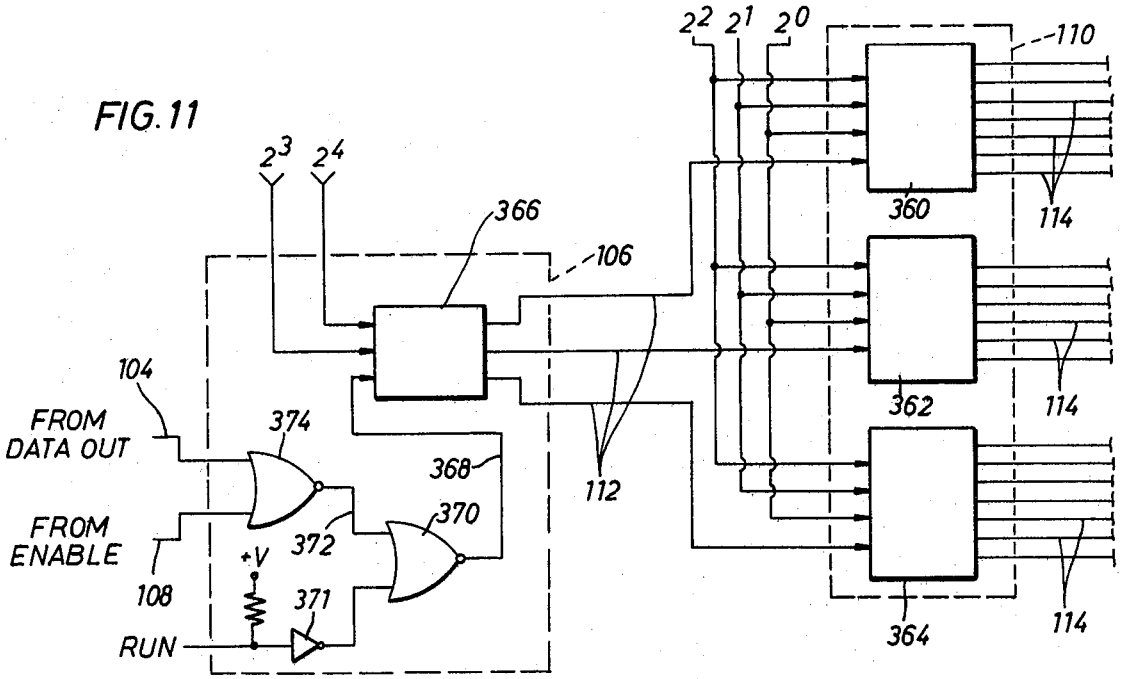
FIG. 11 is a schematic diagram of a demultiplexer utilized in a sorting apparatus embodying the teachings of this invention.

In may be appreciated that while each multiplex channel is up, the read/write enable network 100 causes a reading of the previously stored data in the addressed memory location, such reading being governed by the occurrence of a logic 0 on the Read line 108 from the enable network 100. This occurs when $2^{-2}$ is low and $2^{-1}$ is high. A Read signal on line 108 is transmitted to one input of the demultiplex enable logic network 106 (FIG. 11). The other input terminal of the demultiplex enable logic network 106 is connected to the Data Out terminal of the random access memory element 98 through the line 104.

After the occurrence of the Read pulse, the coincidence of high values on lines $2^{-1}$ and $2^{-2}$ generates a logic zero at the output of the Write terminal of the enable network 100 which is transmitted to the memory element 98 on the Write line 102. A signal on the Write line 102 operates to load into memory the particular classification signal appearing on the line 97 at the Data In terminal of the memory element 98 from the logic network 96.

Figure 12:
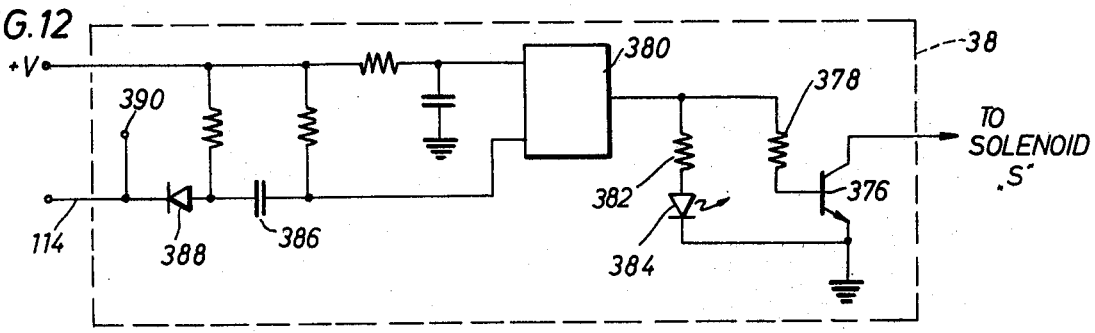
FIG. 12 is a schematic diagram of an ejector actuator or driver utilized in a sorting apparatus embodying the teachings of this invention.

Referring to FIG. 11, a detailed diagram of the demultiplex logic enable circuit 106 and the demultiplex unit 110 is shown. The demultiplex unit 110 includes an array of integrated circuit demultiplexing sections 360, 362, and 364, such as those manufactured by Texas Instruments under manufacturer's number 7442. Input to each of the demultiplexing sections 360, 362, and 364 are the lines $2^0$, $2^1$ and $2^2$ from the timing network 116. Each of the demultiplexing sections 360, 362 and 364 is arranged so that when a particular one of the demultiplexing sections 360, 362, or 364 is enabled, and a particular combination of signal inputs on the lines $2^0$, $2^1$, and $2^2$ is presented to the enabled demultiplexing section, an actuating pulse, in the form of a logic or digital low signal, is transmitted over one of the plurality of lines 114 connected between the demultiplex unit 110 and one of the actuator drivers 38 (FIGS. 1 and 12). The appropriate driver 38 is then actuated to cause the paddle 65 of the appropriate ejector element 31 associated with the viewer element 16 in which an unacceptable product or foreign object has been detected to extend to the article intercept position.

The enablement of one of the particular demultiplexing sections 360, 362, or 364 is effected by the enable network 106. The network 106 includes a integrated circuit element 366, such as that manufactured by Texas Instruments under manufacturer's number 74LS139. The element 366 is connected to the lines $2^3$ and $2^4$ from the timing network 116. The output lines 112 extend from the element 366 to each of the demultiplexing sections 360, 362, and 364. An enabling signal, in the form of a digital low signal, is output to a particular one of the demultiplexing sections 360, 362, or 364 from the element 366. Which of the demultiplexing sections is actuated is dependent upon the particular combination of signals on the lines $2^3$ and $2^4$ when a signal, in the form of digital low signal, is input to the element 366 on a line 368.

The line 368 is connected to a NOR gate 370 which derives one input from a RUN line having a normally low signal thereon (to be discussed herein) and a second input from a line 372 connected from the output of a NOR gate 374. The gate 374 is input with the line 108, from the READ/WRITE ENABLE network 100, and the line 104, from the DATA OUT terminal of the memory element 98.

When there is the simultaneous occurrence of a logic low signal to both inputs of the NOR gate 374, (the low on the line 104 being indicative of the presence of an eject signal in the addressed memory location), a logic high pulse is transmitted on the line 372 to one input of the NOR gate 370. A logic low output from the NOR gate 370 is then presented to the element 366 on the line 368. Dependent upon signals on the lines $2^3$ and $2^4$ when the low signal on the line 368 is input to the element 366, one, and only one, of the demultiplexing sections 360, 362, or 364 is enabled. An appropriate output (a digital low) appears on one of the output lines 114 from the demultiplex unit 110 to actuate the appropriate ejector driver 38.

Referring now to FIG. 12, a typical ejector driver control circuit 38, provided for each of the ejector elements 36 corresponding to each of the viewer elements 16, is shown. As noted, these ejector elements comprise the ejecting means 34 for ejecting an unacceptable product or foreign object from the article stream prior to the deposition thereof on the lower article conveyor 28 (FIG. 1). The solenoid S of the value 67 (FIG. 4) is connected to the collector of an NPN transistor 376. The base of the transistor 376 is connected through a resistor 378 to the output of a single shot multivibrator 380 having a predetermined run down time set by the RC circuit 381. A suitable one-shot is that manufactured by Signetics under model number 556. Connected in shunt between the high side of the resistor 378 and ground are a resistor 382 and a light emitting diode 384 which provides visual indication of actuation of the ejector driver 38. The input of the one-shot circuit 380 is connected through a timing circuit including a parallel resistance-capacitance network 386 to the anode of a diode 388. The diode 388 is connected to one of the output lines 114 (FIG. 11) of the demultiplex unit 110. A test point 390, discussed more fully herein, is provided at the cathode of each diode 388.

Having thus described the elements of a sorting apparatus 10 embodying the teachings of this invention, its operation in the context of a tomato sort on the basis of color may now be discussed. In order to more clearly understand the operation of the circuit elements above described, the following factual situation is assumed: adjacent the discharge end 26 on the upper article conveyor 18 a red ripe tomato is about to pass in free-fall through the sector 14-1 of the viewed area 14 viewed by the viewer element 16-1; about to free-fall through the sector 14-2 viewed by the viewer element 16-2 is a green tomato; about to pass in free-fall through the sector 14-3 of the viewed area 14 viewed by the viewer 16-3 is a foreign object, for example, a dirt clod; and, the fourth through 22nd viewers 16 have nothing within their respective viewed sectors and the outputs thereof continuously generate signals corresponding to their black hole values. It is also assumed that the first article pass has yet to occur, therefore each memory location in the memory element 98 is loaded with a logical high (logic "1").

At the first viewer element 16-1 (multiplex channel 1), it is appreciated that the output of the signal generating means 30 (the light sensors 62 and 64) as amplified by the amplifiers 144, have respectively, a high red and a low green voltage value (FIG. 7). Similarly, the amplified output of the signal generating means 30, the red light sensor 62 of second viewer element 16-2 (multiplex channel 2) has a low voltage value (FIG. 7) while the output of the green light sensor 64 is a high voltage value, due to passage of a green tomato through the viewed sector associated with viewer 16-2. The signal generating means 30, the light sensors 62 and 64 for third viewer 16-3 (multiplex channel 3) which receive reflected light from the foreign object, both exhibit the same currents and therefore the same amplified voltages at the outputs of the amplifiers 144. All other viewers, channels 4 through 22, continuously generate a predetermined output (ideally, zero volts) since they view the black hole reference and the associated amplifiers 144 have been null-adjusted to provide a zero analog voltage output.

In response to the address by enabling pulses $2^4$ and $\overline{2^4}$ and the particular control pulses $2^0$ through $2^3$ provided to the respective red and green multiplexing sections, the multiplexing sections are stepped through and sample each of the 22 parallel channels of information from the 22 viewer elements. A sequential sample is preferred, but not necessary. As discussed above, the inputs contained on each of the input lines 72 are sampled and transmitted on output lines 74 and 76 from the respective red and green multiplexing sections of the multiplex unit 68 to the terminals 160 and 162. It is understood that the memory element 98 and the demultiplex unit 110 are being synchronously stepped with the stepping of the multiplex unit 68.

The first viewer sampled (16-1, multiplex channel 1), contains a high value on the red multiplex output line 74 and a corresponding low value on the green multiplex output line 76. These values are presented to the inverting amplifiers 164 and 166 and are appropriately inverted and scaled.

Simultaneously, the sampled values from the first viewer (16-1), that is, the outputs of the red and green multiplexing sections, are presented to the non-inverting inputs of the comparators 242 and 240, respectively. Since, in the assumed condition there is an article, in this case a red tomato, present in the sector viewed by the first viewer 16-1 multiplex channel 1, the outputs of both of the comparators 240 and 242 are high. One result of the appearance of high outputs from the comparators 240 and 242 is to reverse bias the diode 228 through the line 92. Also, the presence of a high output from the comparators 240 and 242 is input to the inverter 272 and therefore, a low input to the NOR gate 302, maintaining a high output therefrom to maintain the transistor 294 in a non-conductive state. The outputs from amplifiers 164 and 166 are presented to the divide network 80 and an output signal functionally related to the ratio of the green to the red signals sampled from viewer 16-1, multiplex channel 1, is generated at the output 168. This output ratio classification signal is presented through the line 170 to the non-inverting input of the comparator 174.

Since a red tomato is in view in the sector viewed by the first viewer 16-1, multiplex channel 1, the green to red ratio signal on the line 170 is less than the reference voltage set to the comparator 174 and, no output appears on the line 184. Therefore, a logical low signal is presented on the input line 186 of the NOR gate 188. Simultaneously, since the signal on the line 172, indicative of the ratio of the green and red reflected signals viewed by the first viewer 16-1, multiplex channel 1, does not fall between the predetermined voltage window defined by the comparators 198 and 200, there is likewise no signal at the outputs thereof and a low signal therefore appears on the input line to 214 the NOR gate 188. Both logical low inputs to the NOR gate 188 maintain a logical high value at the output thereof, which high output is presented by the line 97 to the Data In pin of the random access memory element 98 while the memory 98 is addressed to the memory location therein corresponding to the sector of the viewed area 14 viewed by the first viewer (16-1), multiplex channel 1.

While the signal generated by the first viewer (16-1), multiplex channel 1, is being sampled and classified, the read/write enable network 100, enabled by the frequencies on the lines $2^{-1}$ and $2^{-2}$, provides a logical low signal to the input line 108 of the NOR gate 374 during the second quarter of this channel time (FIG. 11). However, since the addressed memory location was loaded with a high level (the assumed condition), the input to the gate 374 on the line 104 is a logic high, and the output of the NOR gate 374 on the line 368 maintains a logical low level. Therefore, the logic NOR gate 370 has a low signal input thereto on the line 372, and with the high RUN signal input to the gate 370 through inverter 371, maintains a high output on the line 368 to the element 366. A high output signal from the NOR gate 370 does not premit the element 366 to enable any of the demultiplexing sections 360, 362, or 364. Therefore, no information is transmitted from the demultiplex unit 110 to actuate any of the ejector drivers 38. Thus, although the demultiplex unit 110 is stepped in sychronism with the multiplex unit 68 and the memory element 98, it is seen that only when there exists an eject signal in the particular addressed memory location is a particular demultiplexing section 360, 362, or 364 enabled to activate an ejector driver 38.

During the last quarter of the channel time, the write enable pin of the read/write enable network 100 signals the memory element 98 over the line 102 to insert into the memory element 98 at the addressed memory location (column 1, row 1) the information contained on the line 97 connected to the Data In terminal. Since, in this case, there is a high signal (representing acceptably colored product) on the line 97 from the NOR gate 188, a logical high is inserted in the addressed memory location corresponding to the viewed sector viewed by the first viewer (16-1), multiplex channel 1. It is again noted that both a Read and a Write enable signal are transmitted from the enable network 100 while the appropriate multiplex channel is up and the memory location corresponding to the sector viewed by that viewer element is addressed.

To recapitulate, the situation at the sector 14-1 viewed by the first viewer 16-1 on multiplex channel 1 is that a logical high is stored in the memory element 98 indicating that the article passing through the sector viewed by the first viewer is a product of acceptable color quality and no ejection is initiated.

The second viewer 16-2, on multiplex channel 2, however, sees a green tomato. Therefore, while channel 2 is up and the memory element 98 and demultiplex unit 110 have been synchronously stepped with the multiplex unit 68, the signals sampled from the signal generating means 30 associated with the second viewer 16-2 on multiplex channel 2 are input to the amplifiers 164 and 166. Simultaneously with the presentation of the data on channel 2 to the amplifiers 164 and 166 for the appropriate scaling and inversion, signals are presented to the comparators 240 and 242 for comparison to the threshold voltages. Such comparison again indicates that an article (a green tomato) is present in the viewed sector 14-2 of the viewed area 14 and a high output is produced on the line 92 and at the output of the gate 302. Again, the high output on the line 92 reverse biases the diode 228. The high output from the gate 302 maintains the transistor 294 non-conductive. The appropriate scaled and inverted information sampled by multiplex channel 2 is presented to the divide network 80. In this case, the ratio classification signal on the line 170 presented to the comparator 174 is higher than the reference value input to the inverting terminal thereof and the output 184 of the comparator 174 has a logical high value thereon. A logical high on the output line 184 provides a logical high input to the NOR gate 96 over the line 186 and simultaneously biases the transistor 192 on, so as to permit the light emitting diode 196 to flash. It is noticed, however, that the signal on the line 172 indicative of the ratio classification signal between the green and red signals again does not fall within the predetermined voltage window defined by the comparators 198 and 200 so that no output occurs on the line 214 leading to the NOR gate 188. However, the presence of a high signal on the line 186 to the NOR gate 188 leads to a low output therefrom so a logical low signal is presented to the Data In terminal of the memory element 98 over the line 97 while the memory location associated with the sector viewed by the second viewer as sampled by multiplex channel 2 is addressed. Again, while the second channel is up and while the memory location corresponding to the viewed sector 14-2 is addressed, a Read signal is input to the network 106 on the line 108 and a Write enable signal to the memory element 98. In the case of the Read situation, a high pulse to the NOR gate 374 corresponds to a high value being read from memory (because of the normal preset condition of a high value in all locations) and results in no actuating signal occurring from the demultiplex unit 110 on multiplex channel 2. However, during the Write enable time segment while multiplex channel 2 is up, a logic zero is loaded into the appropriate addressed memory location corresponding to the sector viewed by the viewer 16-2 and sampled on multiplex channel 2. Thus, a logic zero, or a reject signal indicative of the presence of an unacceptable product passing through the viewed sector viewed by the second viewer (16-2) and sampled by multiplex channel 2 is inserted in the appropriate memory location.

In the case of the third viewer (16-3), sampled by multiplex channel 3, both the green and red input lines 74 and 76 have equal values thereon due to the viewing of the dirt clod by the third viewer element. These equal values are presented to the amplifiers 164 and 166 for scaling and inversion. Simultaneously, however, the comparators 240 and 242 indicate by high outputs that again an article is present within the viewing area. Note that the comparators 240 and 242 react to the presence of any article—either a product or a foreign object—in the viewed sector whose viewer output is sampled. Therefore, the high output of the comparators reverse biases the diode 228 through the line 92 in a manner similar to that discussed before, and also maintains the transistor 294 in a non-conductive condition.

Equal voltage signal values are therefore presented to the divide network 80. As above stated, the divide network 80 is of such a character that when equal signals are presented on its inputs, a voltage signal equal to a preset constant voltage (maintained by the capacitor 324) appears at the output 168 thereof. This present voltage is applied through the line 170 to the comparator 174 and, since this output is not greater or more positive than the reference, no output signal appears on the line 184 and a logic low value is present on the line 186 connected to the NOR gate 188. However, the value appearing on the output lines 168 and the line 172 falls between the range of values set on the window comparators 198 and 200, thus leading to a high value being presented to the NOR gate 188 by the line 214. Also, the presence of a logical high value at the comparators' output forward biases the transistor 220 to permit the light emitting diode 224 to fire. The presence of a logical high on the input line 214 to the NOR gate 188 causes the output thereof to go low and presents a low value to the Data In pin of the random access memory element 98 over the line 97. However, while the particular memory location (column 1, cell 3) corresponding to sector viewed by the viewer 16-3 sampled by multiplex channel 3 is being addressed, again both a Read and a Write function are performed due to enablement by the network 106. Again, no trip actuation signal is initiated and none of the demultiplexing sections are enabled since the value read from memory location is a logical high. However, during the Write portion of the time multiplex channel 3 is up, a value indicative of a reject signal is loaded into the appropriate memory location.

On the viewer 16-4 sampled by multiplex channel 4, it is postulated that only the blackhole reference area is viewed. Therefore, there are zero inputs from the signal generating means 30 sampled by multiplex channel 4 by the green and red multiplexing sections. Simultaneous with the presentation of zero inputs from the green and red lines 74 and 76, it is seen that the output of the comparators the 240 and 242 goes low. A low value on the line 92, in effect, disenables the AND gate 312 (FIG. 9) and clamps the cathode of the diode 228 (FIG. 8A) to ground. Also, a low value from the comparators 240 and 242 changes the output of the NOR gate 302 to a low signal to turn on the transistor 294 and present appropriate voltage levels to the comparators 164 and 166, as discussed. The divide network 80 is therefore presented signals of equal values. The divide network 80 operates when signals of equal value are presented thereto to output a constant value, similar to the situation explained for multiplex channel 3, to appear at the output 168 thereof. This output at the line 168 is presented through the line 170 to the comparator 174. Since this output is less than the reference voltage applied to the comparator 174, a logical low is maintained on the line 186 into the NOR gate 188. However, the line 172 presents a value to the comparators 198 and 200 which lies within the "window" defined therebetween. Thus, a high output signal is expected to appear on the output line 214. However, since the comparators 240 and 242, by their low output states have indicated that no article is present in the sector 14-4 viewed by viewer 16-4 sampled on multiplex channel 4, the diode 228 is forward biased. Any positive output signal present on the line 214 is shunted through the forward biased diode 228 and through the comparator network 240 and 242 to ground. Therefore, a logical low value appears at the second input line 214 to the NOR gate 188. A high signal is introduced to the Data In pin of the random access memory element 98 on the line 97.

Again, while the particular memory location corresponding to multiplex channel 4 is being addressed (column 1, row 4) both a Read and a Write function are initiated from the network 100. During the Read portion, a logical high (the initial memory loading) is read from the addressed location. The logical high fails to initiate an actuating signal. During the Write portion a logical 1, derived from the present classification, is loaded into the addressed memory location.

The multiplex unit 68, the memory element 98, and the demultiplex unit 110 continue to be stepped through the remaining multiplex channels 5 through 22. The situation occurring while the null cycle, corresponding to the grounded outputs of the pins 23 through 31 of the multiplexing sections, has been discussed hereinabove. However, after the addressing of all of the memory locations in column 1, that is, rows 1 through 32, the memory element 98 is cycled through another scan of the multiplex channels 1 through 22 and the null cycle. The movement from column 1, row 1, to column 2, row 1, that is, one scan, occurs in a period of time equal to the product of 32 memory locations multiplied by the dwell time for each channel, (approximately 70 microseconds). This dwell time is related to the periodicity of $2^0$, and is adjustable by means of the variable resistor 128 (FIG. 6). Although it is possible that a different article can come into the sector viewed by a given viewer during the time that the memory steps through one column, that is, one complete scan of the 22 viewing sections, it is the more likely situation that the same article which is viewed during the first scan of the viewer elements remains in view during the second or subsequent scans. Thus, it is possible that the same classifying information may be loaded into succeeding memory locations corresponding to each of the sectors viewed by the appropriate viewers.

After the memory element 98 is stepped in synchronism, and preferably in sequence, with the multiplex unit 68 and the demultiplex unit 110 through the entire array of 1024 memory location in like manner, the memory location at column 1, row 1 is again addressed. The time necessary to step through the entire memory array is the predetermined delay time required for an object to pass from the viewed sector to proximity to the corresponding ejector element 36.

When column 1, row 1 is again addressed, a logical 1 previously input from channel 1 is read from memory during the Read portion. Therefore, as discussed, the presence of a logic high in the addressed memory location assigned to the sector viewed by the viewer sampled by channel 1 prevents an actuating signal for the ejecting means associated with that viewer from being fired.

However, when column 1, row 2 is addressed after the predetermined time delay, the logical zero that is recorded therein during the initial scan (previously described) is read and a low value is present both on the Read line 108 and on the data output line 104 leading to the NOR gate 374 (FIG. 11). Therefore, a high signal exists on the output line 372 thereof. This high output signal from the NOR gate 374, coupled with the low signal on the RUN input, generates a low output signal from NOR gate 370 to the element 366 on the line 368. The logic low output value, when combined with appropriagte logic values on the lines $2^3$ and $2^4$, enables only one of the three demultiplexing sections 360, 362, or 364—the appropriate section containing the ejecting means associated with channel 2. A logic low actuating signal is then output on the appropriate line 114 to the appropriate driver 38. Similarly, when the next memory location (column 1, row 3) is addressed, since a logical zero was loaded therein during the previous scan, another logic low actuating signal output from one of the enabled demultiplexing sections 360, 362, or 364 appears on the appropriate line 114 leading to the appropriate ejector driver 38 corresponding to multiplex channel 3. Since multiplex channel 4 is explained to have loaded into memory a logical high, no actuating signal output appears at the demultiplex unit 110 output for multiplex channel 4.

Referring to FIG. 12, a logic low actuating signal to the ejector driver 38 corresponding to the ejecting means associated with channels 2 or 3, derived as previously explained, initiates a 20-millisecond pulse from the appropriate one-shot 380 to turn the associated transistor 376 on and activate the solenoid S of the valve 67. The paddle 65 (FIG. 4) is extended and presented into the free-fall path of the unacceptably colored article (the green tomato, channel 2) to prevent the deposition thereof onto the lower article conveyor 28. It is appreciated that in like manner the ejector paddle 65 associated with the ejector 36 for channel 3, when it is appropriate to do so, is actuated and that paddle 65 presents itself to prevent deposition of the foreign object on the lower article conveyor 28.

Since it is possible that a repeated number of multiplexer scans may result in information about the same object being stored in several memory locations assigned to the same viewing channel, the RC coupled network at the input of the appropriate one-shot 380 prevents repeated triggering thereof. The one-shot 380 is permitted to respond only to the first negative going pulse indicative of an eject actuating signal on the line 114.

As is appreciated from the foregoing, a sorting apparatus is provided which sorts articles randomly disposed across a conveyor by comparison of the value of a classification signal (itself functionally related to the ratio of electrical signals sampled from each viewer element) with a predetermined reference representative of the color of an acceptable article (the comparator 82) and with a predetermined range of values representative of a foreign object (the window comparator 84). As seen, a foreign object reject signal is generated if the value of the ratio classification signal falls within the defined range. The prior art method of utilizing reference values depenent upon light reflected from the product conveyor is avoided, since the belt is not utilized to generate a reference signal.

The sorting apparatus also provides actuating means for actuating the foreign object comparator only if an article is present in the sector viewed by a predetermined viewer. The threshold enable network 88 actuates the window comparators 84 by emitting an actuating signal over the line 92, that signal being functionally related to the presence of electrical signals indicative of an article being present in the appropriate viewed sector. If the signals representative of the article exceed a threshold as set by the network 230, the foreign object reject comparator is actuated. Again, the conveyor is not used as a reference signal to determine the presence of an article in the viewed sector.

The sorting apparatus 10 also provides means for generating a predetermined signal at the output of the divider 80 when equal inputs are presented thereto, these means being the null cycle adjust network 94. The predetermined signal set by the null cycle adjust network, in effect, substitutes a predetermined ratio signal at the divide 80 output when inputs of equal value are presented thereto. The substitute ratio signal is within the window set by the window comparator 84. The bias network 78 is shown to provide predetermined signal inputs to the divide network 80 in response to the threshold enable network 88 over the line 90 if no article is within a viewed sector of a predetermined viewer.

Having thus described the basic circuitry and operating principles of the tomato sorting apparatus 10 utilizing multiplexed inputs and outputs, certain other features of the apparatus 10, including a test sequence therefor and a unique power supply, are now described.

Figure 13:
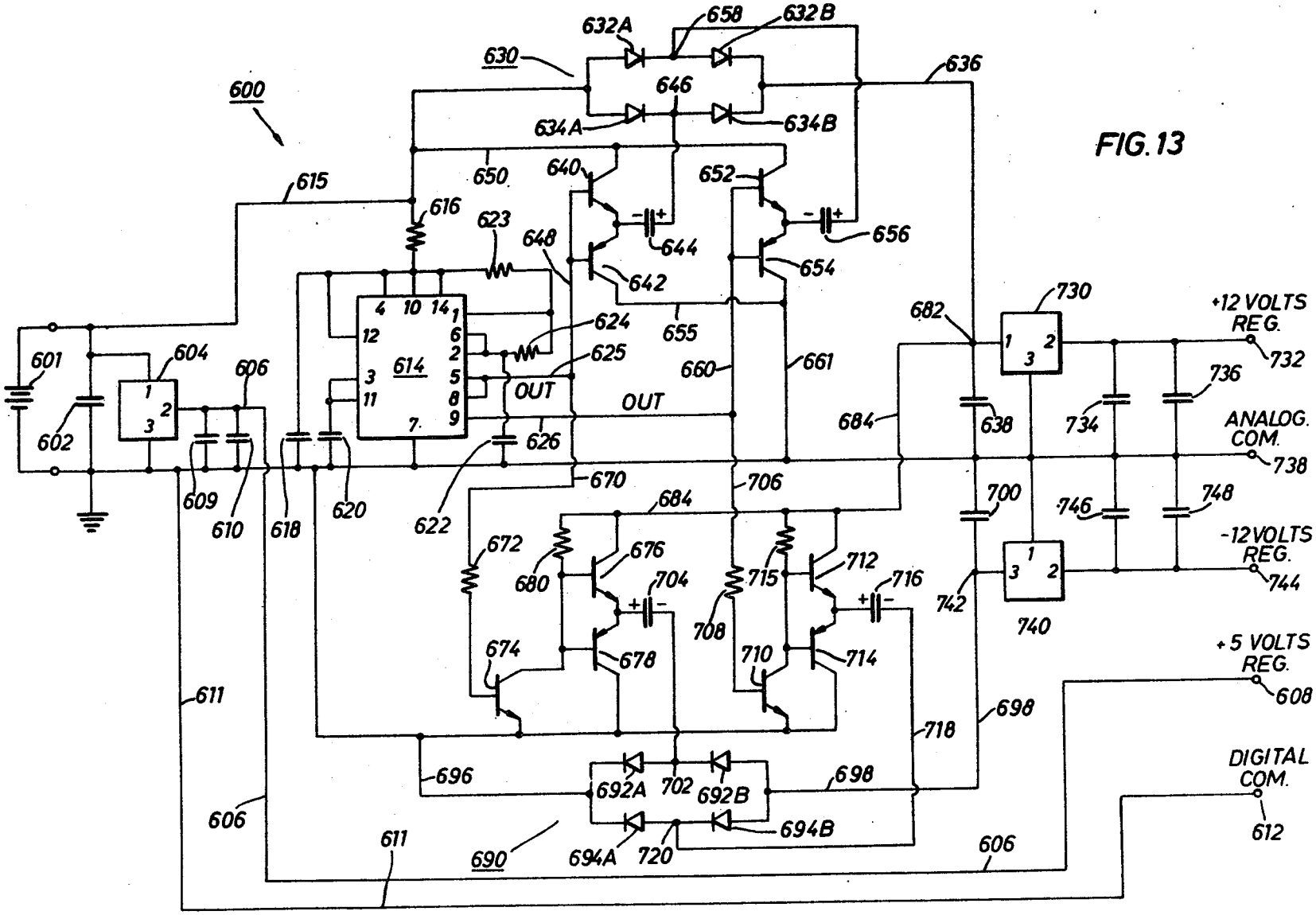
FIG. 13 is a schematic diagram of a capacitor-switching power supply arrangement utilized to provide voltages of predetermined magnitudes for a sorting apparatus embodying the teachings of this invention.

Referring now to FIG. 13, a schematic diagram of a capacitor switching power supply utilized in association with the sorting apparatus 10 embodying the teachings of this invention is generally indicated by referenced numeral 600. It is understood that the power supply is adapted to provide predetermined regulated output voltages of predetermined magnitude of both polarities from a positive direct current voltage source without the need for transformers or inductors for use in the circuitry of a sorting apparatus 10 or any other environment where such requirements are present.

Connected across a positive D.C. voltage source, such as a 12-volt battery 601, are a filtering capacitor 602 and a 5-volt voltage regulator 604. Any standard voltage regulator adapted to provide a regulated 5-volt output, such as that manufactured by Motorola under manufacturer's number 7805, is suitable. The output line 606 of the regulator is connected to an output terminal 608 marked +5 VOLTS REG. It is seen that a regulated +5 volt output is available for use within the sorter circuitry. The power supply 600 is also operable to provide other predetermined output voltages (such as 12 volts) of both polarities, through a capacitive switching arrangement to be described herein.

A local oscillator 614 is connected to the predetermined positive voltage source (for example, the 12-volt output of the battery 601) on a line 615 through a resistor 616. The oscillator 614 may be any suitable oscillator such as that manufactured by Signetics under manufacturer's number 556. The oscillator 614 is connected as shown to filtering capacitors 618, 620, and 622 and to resistors 623 and 624. The outputs of the oscillator 614 are taken through lines 625 and 626 and respectively indicated as OUT and $\overline{\text{OUT}}$.

The line 615 is connected to a diode bridge 630 having first and second legs, respectively including diodes 632A and 632B and 634A and 634B. The bridge 630 is connected to the common line by a line 636 having a filtering capacitor 638. A first transistor switching arrangement comprises a pair of transistors 640 of the NPN type and 642 of the PNP type. The common emitter junction of the transistors 640 and 642 are connected to the negative terminal of a capacitor 644. The positive terminal of the capacitor 644 is tied to a node 646 on the diode bridge 630 between the diodes 634A and 634B. The bases of the transistors 640 and 642 are connected by a line 648 tied to the output line 625 (OUT) of the oscillator 614. The collector of the transistor 640 is connected to the positive voltage source on the line 615 through a line 650. The line 650 is also connected to the collector of a transistor 652 of the NPN type which forms part of a second transistor switching arrangement. The emitter of the transmitter 652 is connected to the emitter of a transistor 654 of the PNP type also included in the second transistor switching arrangement. The tied emitters of the transistors 652 and 654 are connected to the negative terminal of a capacitor 656. The positive terminal of the capacitor 656 is connected to a node 658 on the diode bridge 630 between the diodes 632A and 632B. The bases of the transistors 652 and 654 connected to the output line 626 ($\overline{OUT}$) of the oscillator 614 by a line 660. The collectors of the transistors 642 and 654 are tied to ground by a line 661.

The output OUT on the line 625 of the oscillator 614 is carried by a line 670 through a resistor 672 to the base of a transistor 674 of the NPN type. The emitter of the transistor 674 is tied to ground while the collector thereof is tied to the bases of transistors 676 of the NPN type and 678 of the PNP type which comprise a third transistor switching arrangement. The bases of the transistors 676 and 678 are tied through a resistor 680 to the output of the line 636 from the bridge 630 through connection therewith at a node 682 by a line 684. The collector of the transistor 676 is tied to the line 684 while the collector of the transistor 678 is grounded.

A second diode bridge 690 including first and second legs having diodes 692A and 692B and 694A and 694B, respectively, is tied at one end to ground through a line 696 and at the opposite end through a line 698 and through a filtering capacitor 700 to the ground connection of the capacitor 638. A node 702 between the diodes 692A and 692B is connected to the negative terminal of a capacitor 704 while the positive terminal of the capacitor 704 is connected to the tied emitters of the transistors 676 and 678.

The output line 626 ($\overline{OUT}$) of the oscillator 614 is connected through a line 706 and a resistor 708 to the base of a transistor 710 of the NPN type. The emitter of the transistor 710 is grounded while the collector is tied to the bases of transistors 712 and 714, respectively, of the NPN and PNP type, which form a fourth transistor switching arrangement. The bases of the transistors 712 and 714 are connected through a resistor 715 to the line 684. The collectors of the transistors 712 and 714 are respectively tied to the line 684 and to ground. The tied emitters of the last mentioned transistors are connected to the positive terminal of a capacitor 716. The negative terminal of the capacitor 716 is tied by a line 718 to a node 720 located on the bridge 690 between the diodes 694A and 694B. It is noted that any suitable switching elements may be utilized in place of the transistor switches described and still remain within the teachings of this invention.

A voltage regulator 730 such as that manufactured by Motorola as manufacturer's number 7812 is connected at its input to the output line 636 of the bridge 630 at the node 682. Of course, any suitable voltage regulator able to supply a predetermined regulated voltage output (+12 volts in the specific example here) from a suitable unregulated positive voltage input is suitable as the regulator 730. The regulator 730 output is connected to a terminal post 732 of the power supply 600 indicated as +12 VOLTS REG. with filtering capacitors 734 and 736 being provided. The output line 698 from the diode bridge 690 is connected to a voltage regulator 740, such as that manufactured by Motorola under manufacturer's number 7912, at the node 742. Of course, any regulator able to supply a predetermined regulated, negative voltage output (−12 volts in the specific example here) when presented with an appropriate unregulated negative voltage input is within the contemplation of this invention. The output of the regulator 740 is connected to a terminal post 744 of the power supply 600 indicated as −12 VOLTS REG. with filtering capacitors 746 and 748 being connected as shown. It is understood, of course, that although the first, second, third, and fourth transistor switching arrangements are shown and discussed as a common-emitter arrangement, any other suitable switching arrangement known in the art, (such as common-collector connections or diode switching) is within the contemplation of this invention.

Figure 14:
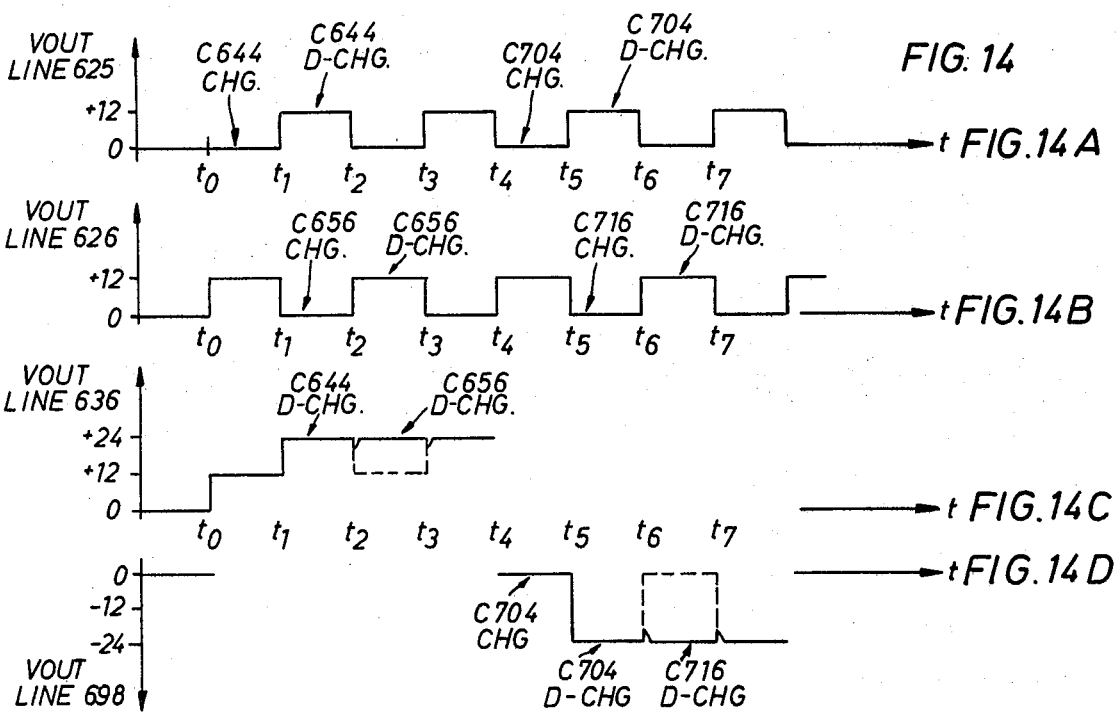
FIGS. 14A–D are timing diagrams indicating the operation of the power supply of FIG. 13; and, FIG. 15 is a schematic diagram of a test arrangement for a sorting apparatus embodying the teachings of this invention.

The operation of the power supply 600 may be understood in connection with FIG. 13 and FIG. 14, which describe the manner in which appropriate unregulated voltages are presented to the regulators 730 and 740. FIG. 14 shows waveform diagrams taken at various points within the circuit of FIG. 13. From FIGS. 14A and 14B it is seen that the oscillator 614 produces a periodic square-wave signal on the OUT line 625 and an output signal on the $\overline{OUT}$ line 626 which is instantaneously of opposite polarity with the square-wave signal produced on the line 625. By instantaneously of opposite polarity it is meant tha the signals on the line 625 is either a logic high or low when the signal on the line 626 is, respectively, a logic low or high, and that signal transitions on the lines 625 and 626 are always oppositely directed.

As seen with reference to FIG. 14, assuming that the power supply 600 is started at time $t_o$ (the battery connected), the output of the oscillator on the line 625 (OUT) is initially at ground potential while the output of the oscillator on the line 626 ($\overline{OUT}$) is, in the specific example here presented, approximately 12 volts positive.

At time $t_o$, the output OUT of the oscillator 614 is on the line 648 and ground potential is applied to the tied base junctions of the common emitter transistor switch 640–642. As a result, the transistor 640 acts as an open circuit while the transistor 642 is, in effect, short-circuited to ground through the lines 655 and 661. With such a condition of the first transistor switch 640–642, the 12-volt output from the battery is connected through the line 615, through the lower leg of the diode bridge 630, through diode 634A and the node 646 to charge the capacitor 644 and place approximately 12 volts on the positive terminal thereof. The output on the line 636 has a potential of approximately +12 volts (battery voltage less two diode drops) since current flows through the upper leg of the bridge through the diodes 632A and 632B.

At time $t_1$, when the output OUT on the line 625 goes high and the output $\overline{OUT}$ on the line 626 goes low (FIGS. 14A & B) the condition of the transistors in the first transistor switch is reversed and the transistor 642 appears as an open circuit while the transistor 640 appears as a short circuit. As a result, the negative side of the capacitor 644 is tied through the short-circuited transistor 640 to the supply line 650. The 12 volts on the positive terminal of the capacitor 644 discharges through the node 646 and the diode 634B to further increase the output of the line 636 from 12 volts to approximately 24 volts.

It is apparent that the provision of the common emitter transistor switch 640–642 only provides, in the specific example here considered, 24 volts on the line 636 for only one-half cycle of the oscillator 614 output on the line 625. Therefore in order to continually maintain the 24-volt output on the line 636, the second common emitter transistor switch 652–654 is provided. The tied base junctions of the transistors 652 and 654 are connected through the line 660 to the output $\overline{OUT}$ on the line 626 of the oscillator 614. It will be recalled that the output $\overline{OUT}$ on the line 626 from the oscillator 614 is instantaneously of opposite polarity with the output OUT on the line 625. Without the provision of the second transistor switch 652–654 the output on the line 636 would decrease at the time $t_2$ back to the approximate 12-volt output, as indicated in the dashed waveform on FIG. 14C.

At time $t_1$, when the output OUT on the line 625 is high, the output $\overline{OUT}$ on the line 626 goes low. As a result, the transistor 652 appears as an open circuit while the transistor 654 shorts to ground through the line 661. Thus the positive terminal of the capacitor 656 connected to the upper leg of the bridge 630 at the node 658 charges to approximately 12 volts. At time $t_2$, when the output $\overline{OUT}$ on the line 626 goes high, the transistor 654 appears as an open circuit while the transistor 652 appears as a short circuit and connects the negative terminal of the capacitor 656 to the supply line 650. Therefore, the positive voltage on the positive terminal of the capacitor 656 discharges through the upper leg of the bridge 630, through the node 658 and the diode 632B to maintain the line 636 at approximately 24 volts. A slight hitch occurs in the output wave form as seen in FIG. 14C, due to the switching of the capacitors.

It may thus be appreciated that due to the complimentary operation of transistor switches 640–642 and 652–654, the capacitors 644 and 656 are alternatively charging and discharging through the nodes 646 and 658, respectively, to maintain the output on the line 636 at a voltage level (in this example, approximately 24-volts positive) to operate the regulator 730.

The line 636 thus presents an unregulated voltage to the input of the regulator 230 sufficient for operation of the regulator. The capacitor 638 is provided to eliminate the slight voltage hitches due to the switching of the capacitors discussed above. The output of the regulator 730 presents a predetermined regulated voltage (here, 12-volts) at the terminal post 732 marked "+12 VOLTS REG." of the power supply 600.

To recapitulate with reference to the waveforms shown in FIG. 18, it is seen that at time $t_o$ there is zero voltage input to the regulator 730. From time $t_o$ through $t_1$ the output presented to the regulator 730 is only 12 volts since during this period of time the capacitor 644 is charging and the capacitor 658 has yet to charge so that no discharge voltage therefrom may be piggybacked to the output line 636. Thereafter however, the capacitors 644 and 656 alternately discharge to maintain a sufficient voltage input to the regulator 730.

It has been asserted in the above discussed example that the output of the switch capacitors on the line 636 is 24 volts. Theoretically and ideally, this is true. However due to various diode drops through the transistor and diode bridges, a more realistic figure for the actual output voltage on the line 636 presented through the node 682 to the regulator 730 for the example discussed is approximately 17 volts. Such an unregulated positive voltage is, however, sufficient to meet the requirements of the regulator 730.

In addition to providing a positive regulated output through the terminal post 732, the power supply 600 embodying the teachings of this invention provides a negative voltage output taken through the terminal post 742 with only the connection of a predetermined positive D.C. source. The capacitor switching arrangement 704 and 716 provides a sufficient unregulated negative voltage to the regulator 740 to maintain a regulated negative output (for example, −12 volts) in the following manner. During the discussion of the specific example that follows, it is assumed that at the node 682, due to the switching action of the capacitors 644 and 656, there has already been provided a positive 24-volt output. That is to say, at least two switching periods, times $t_o$ through $t_1$, have occurred, FIGS. 14A and B. (It is noted that the periodicity i.e., time $t_o$ to time $t_1$ of the oscillator 614, is typically 1 millisecond.)

With the passage of at least two switching times, the node 682 is, in the example, at +24 volts. At time $t_4$, the output on the line 625 OUT goes low and the output on the $\overline{OUT}$ line 626 goes high (FIGS. 14A and B). With the output on the line 625 low, the transistor 674 is maintained off and the tied bases of the transistor switch 676–678 are connected to the positive 24 volts on the line 684 through the resistor 680. As a result, the transistor 676 is conductive and appears as a short circuit while the transistor 678 appears as an open circuit. Thus, the capacitor 704 is presented with the +24 volts on the line 684 and charges to that positive voltage. The negative side of the capacitor 704 is connected to ground through the line 696, the diode 692A and the node 702. Thus, the capacitor 704 has basically been charged from ground potential to the potential on the line 684.

At the time $t_5$, the output OUT on the line 625 goes high (FIG. 14A). As a result the transistor 674 is turned on, pulling the tied bases of the transistors 676 and 678 to ground potential. The transistor 676 is turned off and the transistor 678 is rendered conductive. The positive terminal of the capacitor 704 is therefore tied to ground through the short circuit presented by the conductive transistor 678. The negative terminal of the capacitor 704 is connected through the node 702 and discharges through the diode 692B to the line 698. Thus, at the node 742 at the time $t_5$, the capacitor 704, charged to −24 volts, discharges through the diode 692B to the line 698. Of course, at $t_6$, when the transistor 674 is again opened as the output OUT on the line 625 from the oscillator 614 goes low, the output at the node 742 would tend to drop, as shown in the dotted wave form on FI. 14D. However, during the time ($t_5$ to $t_6$) that the capacitor 704 is discharging to the line 698, the output $\overline{OUT}$ on the line 626 is low and the capacitor 716 is charging in the following manner. With the output $\overline{OUT}$ low the transistor 710 is biased off and consequently the transistor 712 of the common emitter transistor switch 712–714 is turned on and the transistor 714 appears as an open circuit. Therefore, the capacitor 716 is connected at its positive terminal through the short-circuited transistor 712 to the positive 24 volts appearing on the line 684 while the negative terminal of the capacitor 716 is connected through the line 718, the node 720, the diode 694A and the line 696 to ground. Thus, the capacitor 716 charges to the voltage on the line 684.

When $\overline{OUT}$ on the line 626 goes high at the time $t_6$, the transistor 710 is short-circuited and the transistor 712 is turned off while the transistor 714 is turned on. The positive terminal of the capacitor 716 is therefore connected to ground through the conductive transistor 714 while the negative terminal of the capacitor 716 is connected to the line 698 through the line 718, the node 720 and the diode 694B. Therefore the negative terminal of the capacitor 716 discharges through the node 720, through the diode 694B to the line 698. In reference to FIG. 14D, it may be seen that a negative voltage of sufficient magnitude (with the small hitches due to the switching of the capacitors 704 and 716) is presented from the node 742 to the input of the negative voltage regulator 740. The capacitor 700 serves to eliminate the hitches in the voltage wave form discussed above. The output of the regulator 740 is connected through the filtering capacitors 746 and 748 to the output terminal post 744. A regulated negative voltage, for example, −12 volts, therefore appears at the output terminal 744 of the power supply 600.

To briefly recapitulate, after at least two switching times, the capacitor 704 charges while the OUT line 625 is low ($t_4$ to $t_5$). When OUT goes high ($t_5$ to $t_6$) the capacitor 704 discharges to the line 698. While the capacitor 704 discharges ($t_5$ to $t_6$) the output $\overline{\text{OUT}}$ on the line 626 is low and permits the capacitor 716 to charge. When the output $\overline{\text{OUT}}$ again goes high ($t_6$ to $t_7$) the capacitor 716 discharges to the line 698 and the capacitor 794 again charges. Thus, a sufficient unregulated negative voltage is presented to the regulator 740 so that a regulated negative voltage output is provided by the regulator 740 to putput post 744, marked "−12 VOLTS REG" of the power supply 600.

Figure 15:
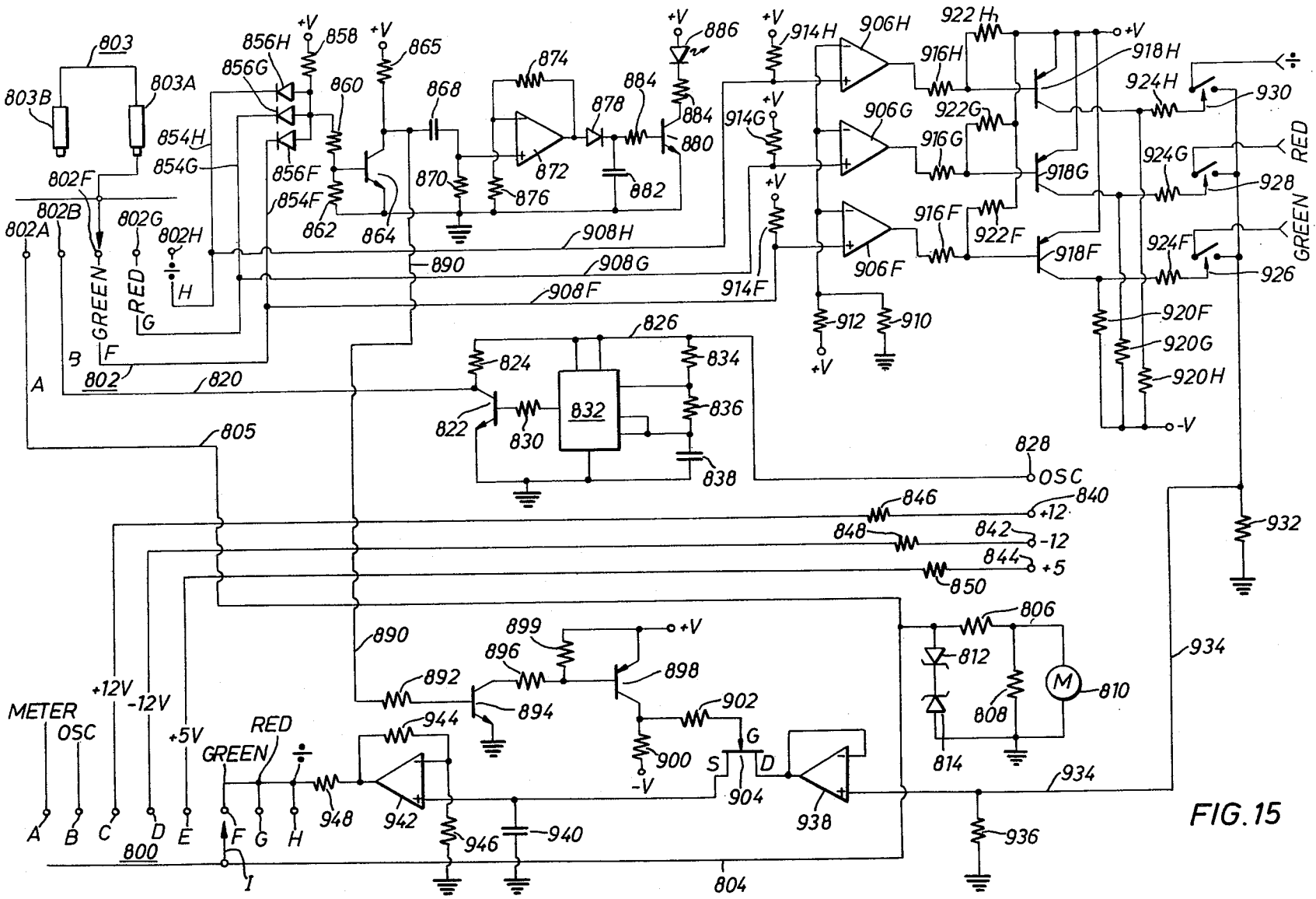

Referring now to FIG. 15, a schematic diagram of a test and meter system for the tomato sorting apparatus 10 utilizing a multiplex arrangement embodying the teachings of this invention is shown.

The circuit described in FIG. 15 permits accurate verification of both the digital logic shifting of the various channels of the multiplexing and demultiplexing circuitry and also permits sampling and display of various of the signals generated at predetermined locations within the multiplex sorter. The test circuitry shown in FIG. 15 is a powerful diagnostic and calibration tool to permit field operators to check the sorter circuitry prior to the start-up thereof.

The flexibility of the test circuitry may best be appreciated with reference to the switches 800 and 802. The switch 800 is a selector having 8 positions shown as METER (800A), OSC (800B), +12V (800C), −12V (800D), +5V (800E), GREEN MUX (800F), RED MUX (800G), and DIVIDE (800H). Selection of any position on the switch 800 internally moves a wiper 800I into contact with the appropriate circuit elements to be described herein. The switch 802 is provided with terminals METER (802A), OSC (802B), GREEN MUX (802F), RED MUX (802G), and DIVIDE (802H), which provide contacts by which one end 803A of a test probe 803 is automatically connected to the various internal circuits of the test circuit while the second end 803B of the probe 803 is connected manually to various circuit test points to be described in more detail herein. Each position of the switches 800–802 illustrated is now described.

Selection of the METER position (800A) permits connection the wiper 800I and any circuit point contacted to the opposite terminal 803B of the probe 803. The wiper 8001 and the terminal 802A are connected, through lines 804 and 805 respectively, to a voltage dividing network comprising resistors 806 and 808. In parallel with the resistor 808 is a suitable voltmeter 810 such as a digital voltmeter manufactured by Mandrel Products of Houston, Texas. An analog meter, such as that manufactured by Weston Instruments may alternatively be used. Zener diodes 812 and 814 are connected as a precaution across the voltage divider network 806–808 to ground.

The next position on the switches 800 and 802 is the oscillator (OSC) position indicated by terminals 800B and 802B, respectively. The terminal 802B is connected through a line 820 to the collector of a transistor 822 of the NPn type. The emitter of the transistor 822 is connected to ground while the collector is tied through a resistor 824 to a line 826 extending to a terminal 828. Connected to the base of the transistor 822 through a resistor 830 is a free running oscillator 832 such as that manufactured by Signetics under manufacturer's number 555. A suitable resistor-capacitor network comprising resistors 834, 836 and a capacitor 838 is connected between the line 836 and ground.

The purpose of the oscillator network above described is to produce a symmetrical square-wave output at the collector of the transistor 822 for connection by the probe 803 to various other locations of the sorter circuitry for test purposes. A positive voltage may be applied to the oscillator 832 to produce the square-wave output. This output signal is coupled through the resistor 830 to the base of the transistor 822 to alternately switch the transistor 822 and provide an output at the collector thereof that is a square-wave varying in amplitude from ground potential to the positive potential at the ground side of the resistor 824.

Selection of the positions 800C, 800D, or 800E, respectively, ties the wiper 800I and the line 804 to the terminals 840, 842, or 844 through a resistor 846, 848, or 850. The terminals 840, 842, and 844 are connected to the corresponding output terminals of the power supply 600 described in connection with FIGS. 13 and 14. Connection of the respective resistors 846, 848, and 850 in series with the voltage divider 806-808 provides an output to the meter 810 to accurately ascertain the operability of the power supply and verify the output voltages there produced.

The test circuit shown in FIG. 15 also permits accurate calibration and checking of the outputs of various functional elements of the sorting apparatus, such as the output of the Green and Red multiplex units, or the output of the divide network 80. For this purpose, the terminals 800F, 800G, and 800H, as well as the terminals 802F, 802G, and 802H, are provided. As is made clear, selection of the appropriate point of interest (GREEN MUX, RED MUX, DIVIDE) is made through the switch 800. The end 803B of the probe 803 is placed in the appropriate test point 390 (FIG. 13) corresponding to the particular multiplex time at which it is desired to examine the output of the particular circuit point selected. The circuitry and operation which permits this to be accomplished are now described.

Each of the terminals 802F, 802G, and 802H is respectively connected through lines 854F, 854G, and 854H to the cathodes of diodes 856F, 856G, and 856H. The anodes of the diodes are each connected through a resistor 858 to a positive voltage source. The anodes of each of the diodes are also connected through an appropriate biasing network comprising resistors 860 and 862 to the base of a transistor 864 of the NPN type. The emitter of the transistor 864 is grounded while the collector is connected through a resistor 865 to a positive voltage source.

An output taken from the collector of the transistor 864 is A.C. coupled through an RC filtering network comprising a capacitor 868 and a resistor 870 and presented to the non-inverting input of an operational amplifier 872. The output of the amplifier 872 is connected to the anode of a diode 878. The cathode of the diode 878 is, in turn, connected to a transistor 880 of the NPN type through a filtering network comprising a capacitor 882 and a resistor 884. The collector output is tied through a resistor 884 and a light emitting diode 886 to a positive voltage source.

A line 890 connected to the collector of the transistor 864 is tied through a resistor 892 to the base of a transistor 894 of the NPN type. The collector of the transistor 894 is coupled through a resistor 896 to the base of a transistor 898 of PNP type. The base of the transistor 898 is connected to a positive voltage source through a resistor 899. The emitter of the transistor 898 is connected to the same source while the collector is tied through a resistor 900 to a negative voltage source. The collector output of the transistor 898 is connected through a resistor 902 to the gate of a field effect transistor 904.

The non-inverting inputs of differential comparators 906F, 906G, and 906H are connected by lines 908F, 908G, and 809H, respectively, to the lines 854F, 854G, and 854H. The inverting inputs of these operational amplifiers are connected to a voltage divider network comprising resistors 910 and 912. The non-inverting inputs of the operational amplifiers 906 are connected to a positive voltage source through resistors 914F, 914G, and 914H.

The output of each of the differential comparators 906 is tied through resistors 916 to the bases of transistors 918 of the PNP type. The collectors of each of the transistors 918 are coupled to a negative voltage source through the resistors 920 while the emitters thereof are tied to a positive voltage source. Suitable biasing resistors 922 are provided.

The respective collectors of the transistors 918 are tied, through resistors 924, to switches 926, 928, and 930, respectively. The switch 930 is connected to the output line 174 of the divide network 80 (FIG. 8A), the switch 928 is connected to the input terminal 160 from the red multiplexing section (FIG. 8A), while the switch 926 is connected to the input terminal 162 from the green multiplexing section (FIG. 8A). The opposite side of the switches 926, 928, and 930 are connected by a line 934 to the non-inverting input of an operational amplifier 938. A shunt resistor 936 is connected between the operational amplifier and ground. The output of the operational amplifier 938 is connected to the drain of the field effect transistor 904. The source of the field effect transistor 904 is connected in parallel with a capacitor 940 and with the non-inverting input of an operational amplifier 942. The output of the amplifier 942 is connected through a resistor 948 to the terminals 800F, 800G, and 800H. Through the wiper 800I and the line 804, the signal at the output of the amplifier 942 is transmitted to the series resistor 806 and the parallel combination of the resistor 808 and the meter 810.

The circuitry thus described provides indication both as to the switching or stepping of the multiplexer through the appropriate channels associated with each viewer element as well as the sampling of the output at several points within the sorter circuitry by sampling that signal at a given multiplex channel time and holding that sample until the multiplexer again steps through to that particular channel.

In operation, it is first necessary to provide means to enable the meter 810 only during the multiplex time period of interest. It is therefore necessary to continuously step the multiplexer output to guarantee that an output periodically occurs on the output lines 114 from the demultiplex unit 110 to the ejector drivers 28 (FIG. 11).

This is accomplished by the actuation of the NOR gate 370 through the inverter 371 connected to the RUN terminal shown in FIG. 11. By pulling the signal on the RUN terminal to ground, the output of the NOR gate 370 goes low. The circuit element 366 therefore continually emits a signal, through the lines 112, to continually enable one of the demultiplexing sections 360, 362, or 364. Further, in response to the particular combination of timing signals and enable pulses from the element 366, each of the output lines 114 to the ejector drivers 38 is steppec through each of the N multiplex channels. Thus, each time that the particular combination of binary clock pulses is input to the demultiplex unit 110, one of the lines 114 associated with a particular multiplex channel goes low. Therefore, it is insured that each multiplex channel is continually actuated at its appropriate multiplex time.

Thus, to isolate a particular multiplex channel time for use in actuation of the test circuitry, it is simply necessary to insert end 803B of the probe 803 into the test point 390 associated with the particular output line 114. (FIG. 12). Once the desired multiplex channel time is isolated, the desired circuit location GREEN MUX, RED MUX, or DIVIDE is isolated by insertion of the first end 803A of the probe 803 into the terminal 802F, 802G, or 802H corresponding to the desired circuit point.

If, for example, it is desired to view the output of the green multiplexer at multiplex time period five, the selector switch 800 is moved to position 800F (GREEN MUX). The probe 803B is inserted to the test point 390 on the output line 114 associated with multiplex channel five. Each time that the selected multiplex channel time slot comes up (channel five in this example), a low signal is placed on the line 854F. A low signal on the line 854F turns off the normally conductive transistor 864 so that the collector output thereof goes high at the selected multiplex channel time.

The periodic square-wave output at the collector of the transistor 864 (going high at each occurrence of the selected multiplex time) is D.C. coupled through the capacitor 868. The pulses presented to the non-inverting input of the amplifier 872 are amplified and, by the action of the diode 878, turn the transistor 880 on to permit the light emitting diode 886 to fire. Only with the presence of the positive and negative pulses (generated by the square-wave input to the capacitor 868) at tne non-inverting input of the amplifier 872 will the light emitting diode 886 fire. This firing of the diode 886 indicates to an external observer that the circuitry of the multiplex apparatus is providing transitory logic levels at the particular multiplex channel time selected.

Through the line 890, as the collector of the transistor 864 goes high at the selected multiplex channel times, the collector of the transistor 894 correspondingly goes low, turning on the transistor 898. Conduction of the transistor 898 pulls the gate of the field effect transistor 904 through the resistor 902 to the positive voltage source. At times other than the selected multiplex channel time, the negative potential is coupled to the gate of the field effect transistor 904 through the resistors 900 and 902.

Having thus enabled the gate of the field effect transistor 904, a signal to the drain of the transistor 904 is obtained in the following manner. As the signal on the line 854F goes low at the selected multiplex channel time, a low signal is transmitted through the line 908F to the non-inverting input of the comparator 906F.

Thus, the output of the comparator 906F goes low at the selected multiplex channel time. As the output from the comparator 906F goes low, the transistor 918 turns on and a positive voltage output taken from the collector of the transistor 918F is applied through the resistor 924F to energize the switch 926. Closure of the switch 926 places the signal then present from the Green multiplexer at the terminal 162 (FIG. 8A) on the line 934. This signal from the Green multiplexer output is transmitted through the line 934 to the non-inverting terminal of the amplifier 938. Therefore, at the selected multiplex time, the output of the Green multiplexer at the terminal 162 is presented to the drain of the field effect transistor 904.

With the field effect transistor 904 enabled, and the selected point of interest of the circuit (Green multiplex output) presented to the transistor 904 at the selected multiplex channel time (channel 5), the sampled signal on the line 934 charges the capacitor 940 to that voltage level. When the selected multiplex channel time passes, the field effect transistor 904 is turned off and the capacitor 940 remains charged to a level substantially equal to the sampled output at the Green multiplexer. The charge on the capacitor 940 is presented to the amplifier 942. The amplifier 942 provides a slight amplification of the signal on the capacitor 940 to compensate for any losses in the field effect transistor 904 and in the switch 926. The output of the amplifier 942 is connected through the resistor 948 and through the contacted wiper 800I (as selected by the switch 800). The signal present at the output of the amplifier 942 (indicative of the signal at the selected circuit point at the selected multiplex channel time) is conducted through the line 804 to the meter 810. In this manner, at the appropriate multiplex channel time slot, signals present at a preselected point within the sorter circuitry are sampled and displayed for diagnostic use. Further, indication of the switching of the logic level within the circuitry is also provided.

What is claimed is:

1. In a sorting apparatus having a time division multiplexer providing a plurality of multiplex times to multiplex a plurality of first and second electrical signals each generated from a plurality of signal generators associated with a corresponding plurality of viewer elements, means for generating an electrical classification signal functionally related to the ratio of said first and second electrical signals, a test circuit comprising:

means for isolating one of said electrical signals at a predetermined point within said sorting apparatus;

means for enabling said isolating means at a predetermined multiplex time;

means for holding said sampled electrical signal for a period of time sufficient for said multiplexer to step through the other of said plurality of multiplex times and return to said predetermined multiplex time; and means for displaying said held signal.

2. The apparatus of claim 1, wherein said first electrical signal is sampled at said predetermined multiplex time.

3. The apparatus of claim 1, wherein said second electrical signal is sampled at said predetermined multiplex time.

4. The apparatus of claim 1, wherein said classification signal is sampled at said predetermined multiplex time.

5. The apparatus of claim 1, wherein said display means is a digital voltmeter.

6. The apparatus of claim 1, wherein said display means is an analog voltmeter.

* * * * *

UNITED STATES PATENT OFFICE

CERTIFICATE OF CORRECTION

Patent No. 4,088,227 Dated May 9, 1978

Inventor(s) James F. Lockett

It is certified that error appears in the above-identified patent and that said Letters Patent are hereby corrected as shown below:

Column 2, line 6, "assinged" should read --assigned--;
line 54, "foreigh" should read --foreign--.
Column 3, line 17, "singal" should read --signal--;
line 17, "refelcted" should read --reflected--;
line 18, "foreighn" should read --foreign--;
line 23, "foreigh" should read --foreign--;
line 59, "sectonal" should read --sectional--.
Column 7, line 36, "predetermind" should read --predetermined--;
line 50, "generatng" should read --generating--.
Column 9, line 64, "viewers" should be deleted and insert --is--.
Column 10, line 45, "ma" should read --may--.
Column 11, line 13, "sequency" should read --sequence--.
Column 12, line 29, "ach" should read --each--;
line 58, "informaion" should read --information--;
line 62, "he" should read --the--.
Column 13, line 3, "operated" should read --operates--;
line 14, "clor commparator" should read --color comparator--;
line 21, "commparator" should read --comparator--.
Column 14, line 6, "he" should read --the--;
line 15, "clor" should read --color--;
line 32, "(FIG." should read --the--;

UNITED STATES PATENT OFFICE

CERTIFICATE OF CORRECTION

Patent No. 4,088,227 Dated May 9, 1978

Inventor(s) James F. Lockett

It is certified that error appears in the above-identified patent and that said Letters Patent are hereby corrected as shown below:

Column 14, line 53, "connectd" should read --connected--;
line 55, "he" should read --the--;
line 59, "oututs" should read --outputs--.
Column 15, line 47, "he" should read --the--.
Column 16, line 10, "he clor" should read --the color--;
line 17, "he" should read --the--;
line 49, "connecion" should read --connection--;
line 50, "channesl" should read --channels--.
Column 17, line 3, "predtermined" should read --predetermined--.
Column 21, line 25, "premit" should read --permit--.
Column 24, line 62 "propriàgte" should read --propriate--.
Column 30, line 42, "FI." should read --FIG.--.
Column 31, line 16, "794" should read --704--;
line 20, "putput" should read --output--.
Column 32, line 2, "NPn" should read --NPN--;
line 10, "836" should read --826--.
Column 33, line 18, "809H" should read --909H--.
Column 34, line 11, "steppec" should read --stepped--;
line 48, "tne" should read --the--.

Signed and Sealed this

*Twentieth* Day of *March 1979*

[SEAL]

*Attest:*

RUTH C. MASON
*Attesting Officer*

DONALD W. BANNER
*Commissioner of Patents and Trademarks*